US012558601B2

(12) United States Patent
Gaudreau et al.

(10) Patent No.: US 12,558,601 B2
(45) Date of Patent: Feb. 24, 2026

(54) HOCKEY PUCK HAVING A TRACKING DEVICE

(71) Applicant: SOUCY BARON INC., Saint-Jérôme (CA)

(72) Inventors: Roch Gaudreau, Baie d'Urfe (CA); Patrice Demartin, Saint-Colomban (CA)

(73) Assignee: SOUCY BARON INC., Saint-Jerome (CA)

( * ) Notice: Subject to any disclaimer, the term of this patent is extended or adjusted under 35 U.S.C. 154(b) by 808 days.

(21) Appl. No.: 17/851,715

(22) Filed: Jun. 28, 2022

(65) Prior Publication Data

US 2022/0409973 A1 Dec. 29, 2022

Related U.S. Application Data

(60) Provisional application No. 63/279,830, filed on Nov. 16, 2021, provisional application No. 63/215,758, filed on Jun. 28, 2021.

(51) Int. Cl.

| | |
|---|---|
| ***A63B 67/14*** | (2006.01) |
| ***A63B 24/00*** | (2006.01) |
| ***A63B 69/00*** | (2006.01) |
| *A63B 102/24* | (2015.01) |

(52) U.S. Cl.

CPC ..... *A63B 67/14* (2013.01); *A63B 24/0021* (2013.01); *A63B 69/0026* (2013.01); *A63B 2024/0028* (2013.01); *A63B 2102/24* (2015.10)

(58) Field of Classification Search

CPC . A63B 67/14; A63B 24/0021; A63B 69/0026; A63B 2024/0028; A63B 2102/24; A63B 2225/50

USPC ..... 463/2–4; 473/446–450, 471–472, 473/478–489, 560, 588–289, 132, 189

See application file for complete search history.

(56) References Cited

U.S. PATENT DOCUMENTS

| | | | | |
|---|---|---|---|---|
| 3,887,188 | A * | 6/1975 | Beauchamp | A63B 67/14 473/588 |
| 4,183,536 | A * | 1/1980 | Platt | A63B 67/14 473/588 |
| 4,968,036 | A * | 11/1990 | Von Der Mark | A63B 67/14 473/570 |
| 5,284,343 | A * | 2/1994 | Bigornia | A63B 21/0605 473/588 |
| 7,621,833 | B2 | 11/2009 | Proulx et al. | |
| 10,016,669 | B2 * | 7/2018 | Mason | A63B 24/0021 |
| 10,343,042 | B2 | 7/2019 | Mason et al. | |
| 10,500,474 | B2 * | 12/2019 | Guillemette | A63H 33/18 |
| 10,675,526 | B2 * | 6/2020 | Moyerman | A63B 71/0605 |
| 2009/0029754 | A1 * | 1/2009 | Slocum | A63B 24/0087 463/32 |

(Continued)

FOREIGN PATENT DOCUMENTS

| | | | | |
|---|---|---|---|---|
| CA | 1305734 C | * | 7/1992 | A63B 43/06 |
| CA | 2225671 A1 | * | 1/1997 | |

(Continued)

*Primary Examiner* — Kiley S Stoner
(74) *Attorney, Agent, or Firm* — BCF LLP

(57) ABSTRACT

The present technology generally relates to a puck comprising a body and a tracking device receivable in the body. The tracking device is generally aligned with a center of gravity of the body of the puck and with a geometrical center of the body of the puck.

19 Claims, 15 Drawing Sheets

(56) References Cited

U.S. PATENT DOCUMENTS

| | | | | |
|---|---|---|---|---|
| 2014/0013361 | A1* | 1/2014 | Monari | H04N 21/41415 725/62 |
| 2018/0065012 | A1* | 3/2018 | Mason | A63B 71/06 |
| 2019/0209905 | A1* | 7/2019 | Huther | A63B 67/14 |
| 2019/0344143 | A1 | 11/2019 | Mason et al. | |
| 2020/0276487 | A1* | 9/2020 | Hall | A63B 71/06 |
| 2020/0330830 | A1* | 10/2020 | Carew-Jones | A63B 43/004 |
| 2020/0398111 | A1* | 12/2020 | Near | G01V 15/00 |
| 2022/0088460 | A1* | 3/2022 | Roberts, II | A63B 67/14 |
| 2022/0193515 | A1* | 6/2022 | Near | A63B 67/14 |
| 2022/0280852 | A1* | 9/2022 | Mason | A63B 67/14 |
| 2023/0381619 | A1* | 11/2023 | Roberts, II | A63B 67/14 |
| 2024/0238650 | A1* | 7/2024 | Roberts, II | A63B 24/0003 |

FOREIGN PATENT DOCUMENTS

| | | | | |
|---|---|---|---|---|
| CA | 2225722 | A1 * | 1/1997 | |
| CA | 3036032 | A1 * | 9/2019 | A63B 24/0021 |
| CA | 3225023 | A1 * | 1/2023 | A63B 67/14 |
| CZ | 33082 | U1 * | 8/2019 | |
| CZ | 2019311 | A3 * | 10/2020 | |
| DE | 4222679 | A1 * | 1/1994 | A63B 67/14 |
| FI | 20176139 | A1 * | 6/2019 | |
| WO | WO-8800075 | A2 * | 1/1988 | |
| WO | WO-2005089498 | A2 * | 9/2005 | A63B 69/3658 |
| WO | WO-2005089890 | A1 * | 9/2005 | A63B 24/0021 |
| WO | WO-2008033338 | A2 * | 3/2008 | A63B 24/0003 |
| WO | WO-2019122512 | A1 * | 6/2019 | A63B 24/0021 |
| WO | WO-2021058359 | A1 * | 4/2021 | A63B 24/0021 |
| WO | WO-2022055498 | A1 * | 3/2022 | A63B 43/004 |
| WO | WO-2023009866 | A2 * | 2/2023 | A63B 24/0021 |

* cited by examiner

HOCKEY PUCK HAVING A TRACKING DEVICE

CROSS-REFERENCE

The present application claims priority to U.S. Provisional Patent Application No. 63/215,758, filed Jun. 28, 2021 entitled "Sports Apparatus Comprising an Embedded Tracking Device, System and Method for Making the Same", which is incorporated by reference herein in its entirety. The present application also claims priority to U.S. Provisional Patent Application No. 63/279,830, filed Nov. 16, 2021 entitled "Sports Apparatus Comprising an Embedded Tracking Device, System and Method for Making the Same", which is also incorporated by reference herein in its entirety.

TECHNICAL FIELD

The present application generally relates to sports apparatus having a tracking device therein. Specifically, the present technology relates to hockey pucks.

BACKGROUND

As observed in a variety of sports, integration of tracking devices into sporting apparatus and/or equipment is desirable to obtain accurate and reliable data, such as motion properties, thereabout. This can allow athletes, trainers and coaches to improve their training. Incorporating a tracking device (i.e., an electronic device) into the sport apparatus and/or equipment can convert the initially "passive" sport apparatus and/or equipment into a "smart" or "active" sports apparatus.

The tracking device can measure, sense and/or record forces applied on the sporting apparatus and/or equipment, accelerations, speeds. In some instances, the tracking device can also process data, track position, and transmit signals to an external processing apparatus, etc. It is understood that in some cases, these operations can be performed in real-time, quasi-real-time (i.e. with a pre-determined delay) or stored in a memory unit for further use, for instance.

Incorporating such tracking device into a conventional hockey puck can be difficult, as the addition of a foreign body inside the hockey puck would modify its properties and characteristics, and thus alter it with regard to conventional hockey pucks. This can be problematic for athletes, which would rather practice with official pucks.

Furthermore, incorporating the tracking device can also be a challenge in terms of material selection, formulation and/or assembly configuration, in order to allow signal transmission from the tracking device to an external processing unit without affecting said signal.

Additionally, it can be difficult to manufacture a puck while having strong mechanical properties, such as impact resistance, resilience, crack propagation resistance, wear resistance, hardness, weight, location of center of gravity location, etc.

Indeed, manufacturability and production cost are additional aspects that need to be taken into account to end up with a commercially viable product, especially for non-professional hockey pucks. Scrutiny is required in manufacturing "smart pucks" since more steps are involved in, compared to manufacturing standard "passive" pucks.

Therefore, there is a desire for a hockey puck than can overcome at least some of the above-described problems.

SUMMARY

It is an object of the present technology to ameliorate at least some of the inconveniences present in the prior art.

According to one aspect of the present technology, there is provided a puck including a body and a tracking device that is receivable in the body. The tracking device is generally aligned with a center of gravity of the body, and with a geometrical center of the body.

In some embodiments, the puck further includes a receptacle configured to receive the tracking device therein, and configured to be received in the body.

In some embodiments, the receptacle has a protruding portion configured to receive part of the tracking device therein.

In some embodiments, the part of the tracking device is at least one of a charging base and a light-emitting device.

In some embodiments, the body defines a body cavity.

In some embodiments, the body cavity extends from a first surface of the body toward a second surface of the body.

In some embodiments, the puck further includes a cap configured to close the body cavity.

In some embodiments, the cap has a first connecting feature, the body has a second connecting feature, and the cap and the body are connectable via the first and second connecting features.

In some embodiments, the puck includes an isolating layer configured to withstand molding pressures of up to about 15 000 kPa and molding temperatures of up to about 250° C.

In some embodiments, the tracking system is communicatively connectable to a controller.

According to another aspect of the present technology, there is provided a puck, a body made of body material, a receptacle within the body, and a tracking device received in the receptacle. An outer surface of the receptacle is in direct contact with the body material.

In some embodiments, the tracking device is communicatively connectable to a controller.

In some embodiments, the body material is molded around a substantial portion of the receptable.

In some embodiments, the receptacle comprises an isolating material configured to withstand molding pressures of up to about 15 000 kPa and molding temperatures of up to about 250° C.

In some embodiments, the tracking device is generally aligned with a center of gravity of the body, and a geometrical center of the body.

In some embodiments, the body material defines a body cavity extending from a first surface of the body toward a second surface of the body, and at least a portion of the receptacle extends until the first surface.

In some embodiments, the at least a portion of the receptacle is a protruding portion configured to receive part of the tracking device therein.

In some embodiments, the part of the tracking device is at least one of a charging base and a light-emitting device.

In some embodiments, the puck further includes a cap for closing the body cavity, the cap being configured to receive the protruding portion therethrough.

In some embodiments, the puck is a hockey puck.

According to another aspect of the present technology, there is provided a method for manufacturing a puck. The method includes receiving a tracking device in a receptacle, and, molding a body material around the receptacle to form a body of the puck, such that the tracking device is generally aligned with a geometrical center of the body of the puck.

In some embodiments, the method further includes surrounding the receptacle with an isolating layer configured to withstand molding pressures of up to about 15 000 kPa and molding temperatures of up to about 250° C.

According to another aspect of the present technology, there is provided a puck assembly comprising a puck as defined herein and comprising together with a charger configured to wirelessly charge the tracking device of the puck.

In the context of the present specification, unless expressly provided otherwise, the words "first", "second", "third", etc. have been used as adjectives only for the purpose of allowing for distinction between the nouns that they modify from one another, and not for the purpose of describing any particular relationship between those nouns.

It must be noted that, as used in this specification and the appended claims, the singular form "a", "an" and "the" include plural referents unless the context clearly dictates otherwise.

As used herein, the term "about" in the context of a given value or range refers to a value or range that is within 20%, preferably within 10%, and more preferably within 5% of the given value or range.

As used herein, the term "and/or" is to be taken as specific disclosure of each of the two specified features or components with or without the other. For example, "A and/or B" is to be taken as specific disclosure of each of (i) A, (ii) B and (iii) A and B, just as if each is set out individually herein.

Implementations of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1A:
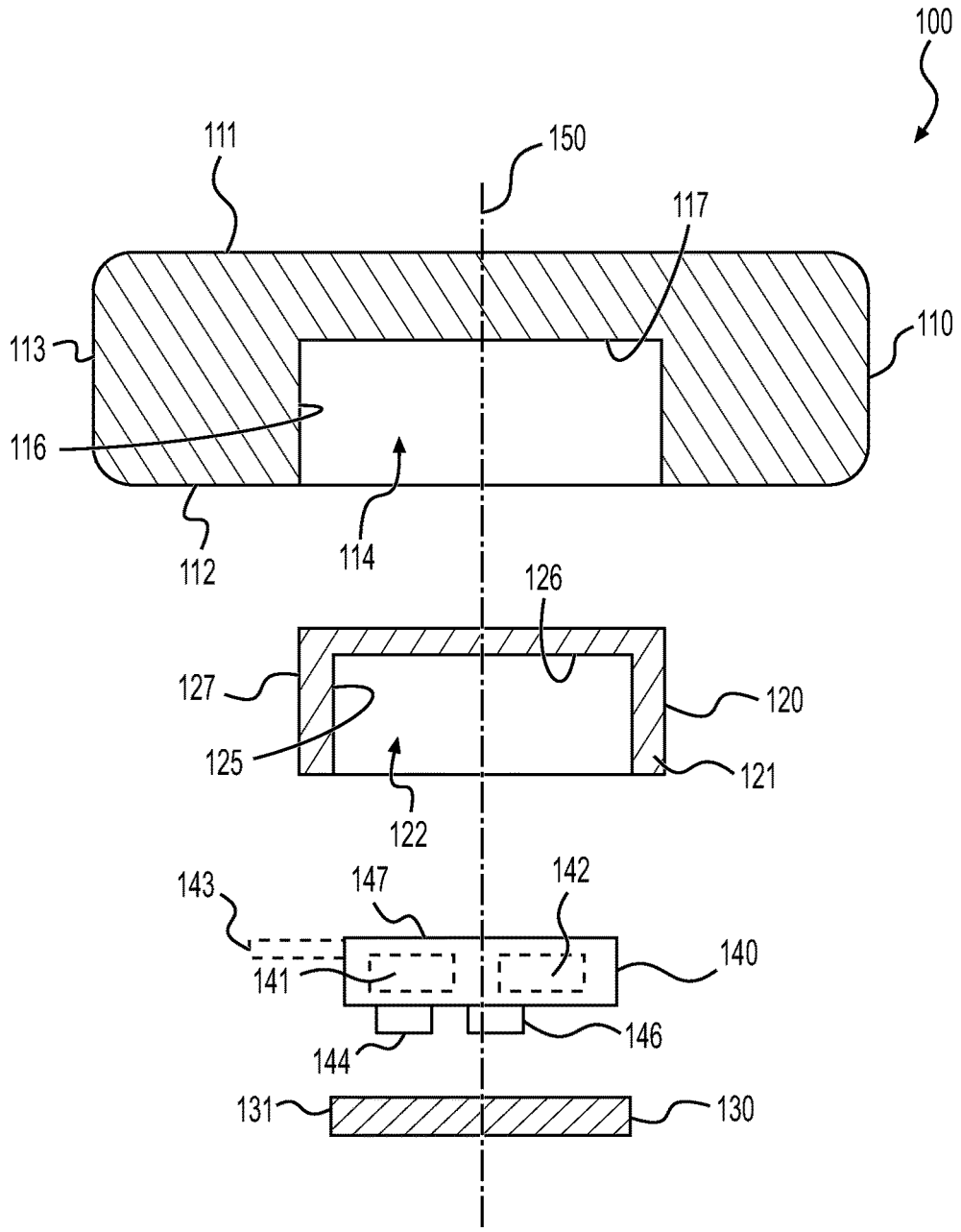
FIG. 1A is a cross-sectional view of a puck according to an embodiment of the present technology, the cross-sectional view being taken along a center plane of the puck.

The present disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including", "comprising", or "having", "containing", "involving" and variations thereof herein, is meant to encompass the items listed thereafter as well as, optionally, additional items. In the following description, the same numerical references refer to similar elements.

The present disclosure relates to sports equipment, specifically sports equipment including a tracking device received therein. More precisely, the present technology relates to hockey pucks. The puck is configured to be manipulated, either directly or indirectly, by a sport player such that the puck undergoes movement. The present disclosure describes specifically a hockey puck comprising a tracking device. Reference herein to hockey pucks or skills associated with hockey does not limit the disclosed sports equipment to being only a hockey puck, or to being used only in the sport of hockey. It is understood that the described principles and configurations for joining the multiple parts of a hockey puck and a tracking device can be applied to join multiple parts of different sports goods or equipment as mentioned above.

Figure 1B:
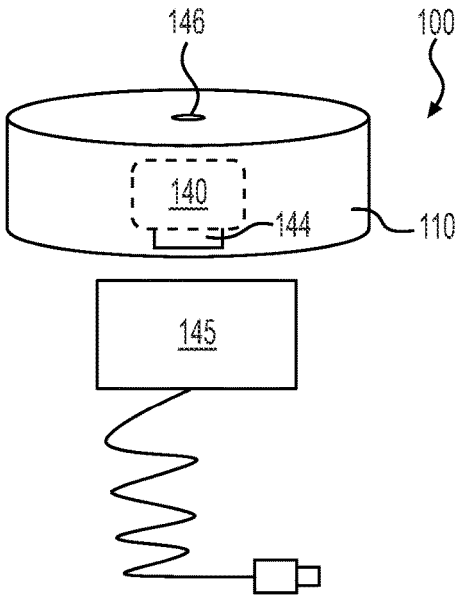
FIG. 1B is a perspective view of the puck of FIG. 1A with a wireless charger.
Figure 1C:
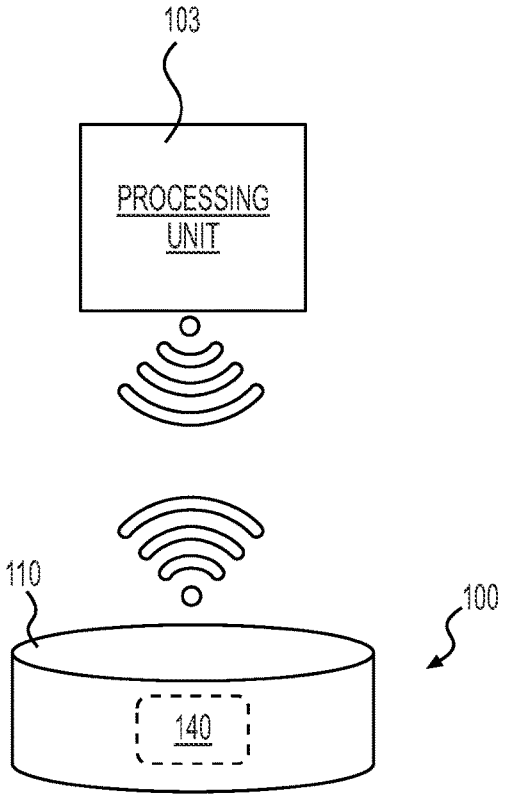
FIG. 1C is a schematic view of the puck of FIG. 1A and a processing unit.

Referring to FIGS. 1A, 1B, 1C, a hockey puck 100 according to an embodiment of the present technology will be described. Official hockey pucks used in professional games are designed to meet specific requirements in order to standardize their properties (e.g., mechanical resistance, hardness, resilience, bouncing behavior, geometry, centre of gravity, mass, tear/chip resistance, etc.). This is done to regularize their overall behavior during use. For example, CSA International Z262.4 standard is typically used as a reference for most of these requirements. For non-professional applications, similar properties and requirements are considered and aimed as well. The hockey puck 100 described herewith generally meets these requirements.

Generally speaking, the hockey puck 100 includes a body 110, a receptacle 120, a cap 130, and a tracking device 140. It is contemplated that in some embodiments, the hockey puck 100 could have more or fewer features. As will be described below, the tracking device 140 is configured to be received in the receptacle 120, which in turns is configured to be received in the body 110. The cap 130 is configured to seal the tracking device 140 within the receptacle 120 and/or is configured to seal the receptacle 120 within the body 110.

The tracking device 140, the receptacle 120, the cap 130 and the body 110 could be connected to one another in different ways, including permanent or removable connections. For example, without being limited thereto, one of the part could be connected to an other one of the parts by pressing (e.g., interference fit), by welding (e.g., ultrasonic welding), by bonding (e.g., adhesive), by mechanical interlocking (e.g., male-female connection, snap fit), by threading, by overmolding, and/or by fastening. These connections will be described and illustrated in further detail below through different embodiments. Other connections are contemplated as well. Additionally, two or more connections can be used simultaneously. For instance, in addition to two parts being connected by a mechanical interlocking connection (e.g., snap fit), said two parts can also be connected via welding (e.g., ultrasonic welding) to permanently connect them together.

The body 110, which is disc-shaped, has a top surface 111, a bottom surface 112 that is spaced from the top surface 111, and a peripheral surface 113 that extends between the top and bottom flat surfaces 111, 112. The top and bottom flat surfaces 111, 112 are generally flat. The body 110 also defines an axis 150 extending through a centre of the top and bottom flat surfaces 111, 112. A body cavity 114 is defined in the body 110. The body cavity 114 extends from the bottom surface 112 toward the top surface 111 along the axis 150. It is contemplated that in some embodiments, the body cavity 114 could extend from the top surface 111 and/or from the peripheral surface 113. The body 110 has an internal surface 116 and a bottom surface 117 that partially define the body cavity 114. As will be described in greater detail below, the body cavity 114 is configured to receive the receptacle 120 and/or the tracking device 140. In some embodiments, the body cavity 114 could have a complementary relationship with an external surface 127 of the receptacle 120.

In some embodiments, the body 110 is first formed with the body cavity 114 and the receptacle 120 is configured to subsequently fit into the body cavity 114. In other embodiments, the receptacle 120 could first be formed and then, the body 110 could be subsequently formed around the receptacle 120 (e.g., via an overmolding process), such that the body cavity 114 is formed by surrounding the receptacle 120.

The body 110 has a thickness of about one inch, a diameter of about three inches and a mass of about six ounces. The body 110 is made of a unitary part, though it is contemplated that in other embodiments, the body 110 could be made of two or more parts connectable to one another. The body 110 is made of a body material. The body material is a resilient material such as a rubber compound, which can be suitable for on-ice applications, and/or a polymer, which can be suitable for off-ice applications. Other materials or combination of materials are contemplated as well.

With continued reference to FIGS. 1A, 1B and 1C, the receptacle 120, which is configured to be within the body 110, more specifically in the body cavity 114, will now be described. The receptacle 120 has a receptacle body 121.The receptacle body 121 is generally cylindrical, but it is contemplated that in other embodiments, the receptacle body 121 could have another shape. For example, the receptacle body 121 could have a polygonal shape. In some embodiments, the shape of the receptacle body 121 could vary according to the shape of the tracking device 140. In some embodiments, the external surface 127 of the receptacle body 121 has threads to, as mentioned above, configured to engage with the internal surface 116 of the body 110. It is contemplated that in other embodiments, the external shape of the receptacle body 121 could include protrusions, cavities, surface finish, or other features that could enhance connection between the receptacle 120 and the body 110.

The receptacle body 121 defines a receptacle cavity 122 that is configured to receive the tracking device 140. In some embodiments, the receptacle 120 is configured to secure the tracking device 140 within the receptacle cavity 122. The receptacle body 121 has an internal surface 125 and a bottom surface 126 that partially define the receptacle cavity 122. In some embodiments, the receptacle cavity 122 could be through, such that the receptacle body 121 would generally have an annular shape.

In some embodiments, the receptacle 120 could include two or more receptacles. In other embodiments, the receptacle 120 could be omitted. In such embodiments, the tracking device 140 could be received directly into the body 110. For example, the tracking device 140 could be embedded into the body 110. In an alternate example, the tracking device 140 could be connectable to the cap 130.

The receptacle body 121 is made of a polymeric material (e.g., thermoplastics, thermosetting plastics, elastomers, silicones, etc.). In some embodiments, the receptacle body 121 could be made of another material (e.g., a metal) or a combination of materials (e.g., composite materials) having suitable properties (e.g., mechanical properties, chemical properties, radio-frequency transparency).

In some embodiments, the receptacle 120 could be complementary to the body 110. In some embodiments, the receptacle 120 could be in direct contact with the body 110.

Still referring to FIGS. 1A, 1B and 1C, the cap 130 will now be described in greater detail. The cap 130 has a cap body 131 that is configured to close the receptacle cavity 122. It is contemplated that in some embodiments, the cap 130 could be configured to close the body cavity 114, such as in instances where the receptacle 120 is omitted.

The cap body 131 is shaped to be complementary to the body cavity 114 such that when the puck 100 is assembled, the cap 130 is flush with the body 110. In some embodiments, the cap body 131 could be configured to be complementary to the receptacle cavity 122. In some cases, the cap body 131 could have an overhang, such that the cap body 131 could be larger than the cavity it closes. This can notably be the case when the connection between the cap 130 and the body 110 or the cap 130 and the receptacle 120 is an interference fit.

It is contemplated that in some embodiments, there could be two or more caps 130. In some embodiments, the cap 130 could be omitted and the body cavity 114 or the receptacle cavity 122 could be closed differently.

The cap body 131, similarly to the receptacle body 121, is made of a polymeric material (e.g., thermoplastics, thermosetting plastics, elastomers, silicones). In some embodiments, the cap body 131 can be made of another material (e.g. a metal) or combination of materials (e.g., composite materials) having suitable properties (e.g., mechanical properties, chemical properties, radio-frequency transparency). In some embodiments, the receptacle body 121 and the cap body 131 and could be with the same material. In other embodiments, the receptacle body 121 and the cap body 131 could be made of different materials.

The tracking device 140 includes an electronic device 141 and a power unit 142. The electronic device 141 includes various electronic components such as boards, microprocessors, chips, sensors, power control units, and/or communications circuitry. The chips can be Bluetooth communication chip or Wireless charger chip, and the sensors could be accelerometers, magnetoresistive sensors or radio-frequency identification (RFID). It is contemplated that the electronic device 141 could include more or less components. The power unit 142 is a chargeable battery. It is contemplated that the power unit 142 could be another type of powering unit. The communications circuitry is configured to transmit and/or receive data to and/or from a processing unit 103 such as a computer or a smartphone. Examples of such data transmission include, without being limited to, WiFi and Bluetooth technologies. The electronic device 141 further includes a memory unit for storing measured data, where the measured date is transferrable to an external processing unit.

The tracking device 140 further includes an antenna 143 that is electronically connected to the electronic device 141, and that is configured to enhance radio-frequency transmission thereof. In some embodiments, the antenna 143 could be omitted.

Thus, the tracking device 140 is communicatively connected to an external controller so as to communicate data tracked thereby to said external controller. In some embodiments, the controller could be a computer. In other embodiments, the controller could be a mobile device.

The tracking device 140 further includes a charging base 144 that is electronically connected to the power unit 142 and this is configured to wirelessly charge the power unit 142 via a wireless charger 145. The wireless charger 145 could have a connector such as a Universal Serial Bus Type C (USB-C), a Universal Serial Bus Type A (USB-A), or a power outlet. In other embodiments, the charging base 144 could be configured to charge the power unit 142 through a wire, which, when received in the body 110, could be accessible by removing the cap 130. It is contemplated that the charging base 144 could be omitted in some embodiments.

In some embodiments, the tracking device 140 further includes a light-emitting device 146 that is electronically connected to the power unit 142. The light-emitted device 146 could be configured to emit a light for communicating a message. For example, the light-emitting device 146 could emit a red light when data is being recorded, and/or could emit a green light when data is being transferred. In other embodiments, the light-emitting device could emit a light when charging.

In some embodiments, the body 110 could be molded around the tracking device 140. In such embodiments, the components of the tracking device 140, the enclosure 147 and/or the receptacle 120 are selected to resist to high temperatures and/or high pressures, in some instances due to molding conditions, so that the tracking device 140 remains functional. In some embodiments, during molding of a part of the hockey puck 100, the tracking device 140 can be exposed to temperatures of up to about 480 F (about 250° C.), or temperatures varying between about 300° F. and about 400° F. (about 150° C. and about 200° C.) and pressures of up to about 2175 psi (about 15 000 kPa), or pressures varying between about 1000 psi and about 2000 psi (about 6900 kPa and about 13800 kPa).

In other embodiments, the tracking device 140 could be inserted into the part configured to contain it after the molding process thereof, so that the tracking device 140 would not be exposed to high temperatures and/or high pressures.

In some instances, the tracking device 140 is generally aligned with a center of gravity of the body 110. As such, a center of gravity of the puck 100, is generally aligned with geometrical center of gravity of the puck 100.

In some embodiments, the body 110, the receptacle 120 and/or the cap 130 could have one or more cutouts and/or thickness reductions to allow better radio-frequency transmission through the material.

First Embodiment

Figure 2:
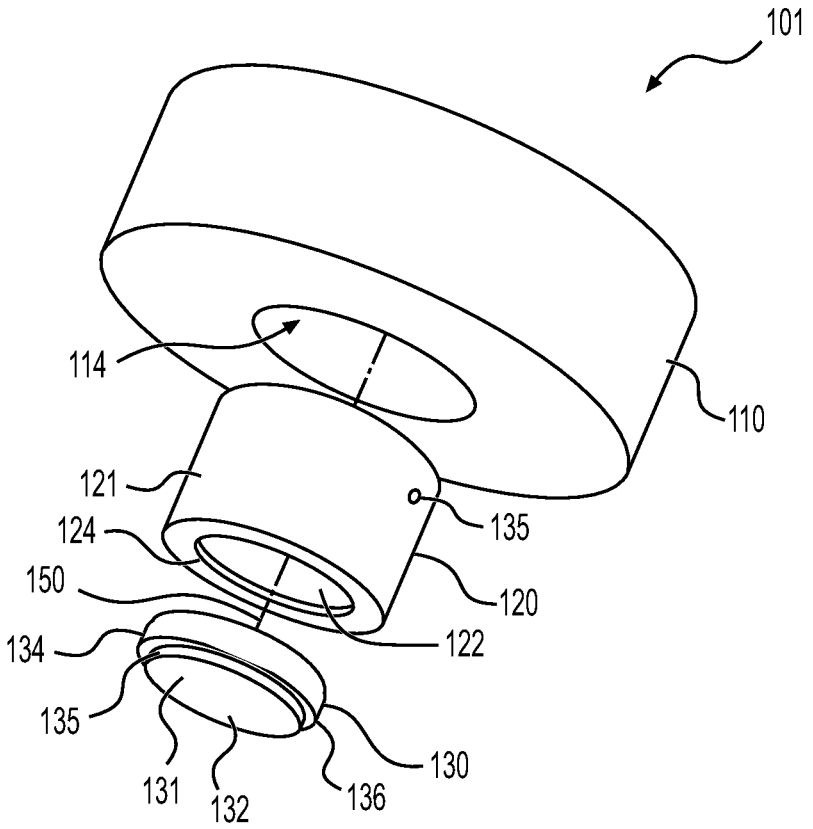
FIG. 2 is a perspective view taken from a bottom of a puck according to an embodiment of the present technology.
Figure 3:
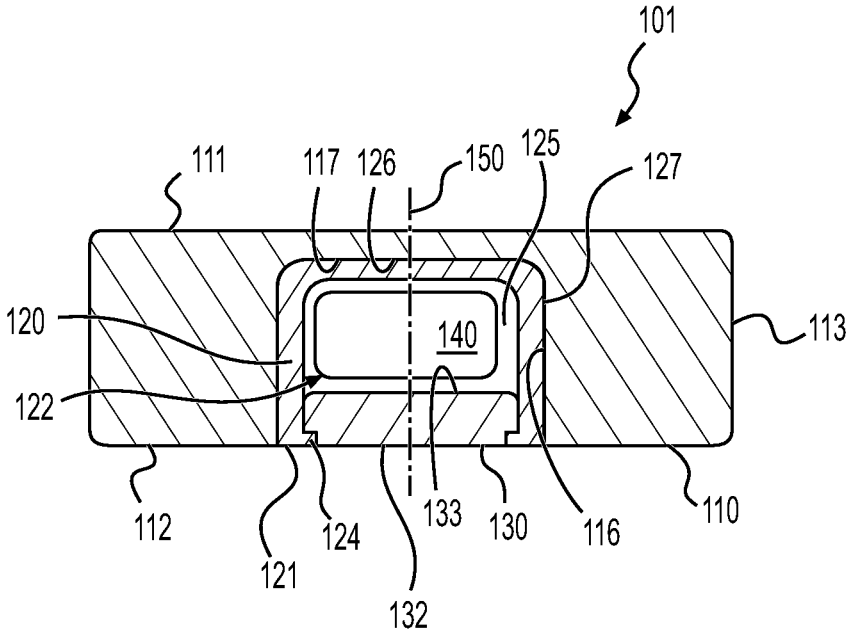
FIG. 3 is a cross-sectional view taken along a center plane of the puck of FIG. 2.

Now referring to FIGS. 2 and 3, a first embodiment of a hockey puck 100 according to the present technology, namely hockey puck 101, will be described. For conciseness, features of the hockey puck 101 similar to those of the hockey puck 100 have been labeled with the same reference numerals, and will not be described in detail herewith. In other words, only notable differences between the general description of the hockey puck 100 and the hockey puck 101 will be described.

The hockey puck 101 has the body 110, the receptacle 120, the cap 130, and the tracking device 140.

In this embodiment, the receptacle body 121 has a connecting feature 124. In the present embodiment, the connecting feature 124 is a lip 124 extending radially inwardly from a bottom end of the internal surface 125.

In this embodiment, the receptacle body 121 is made of a resilient material such that the receptacle body 121 can elastically deform by a certain amount without breaking. As such, the lip 124 is resiliently deformable. It is contemplated that in some embodiments, the lip 124 could be made of a different material than the rest of the receptacle body 121.

In this embodiment, the cap 130 has the cap body 131 that is sized and configured to be received within the receptacle cavity 122. The cap 130 defines an outer surface 132, an inner surface 133 spaced from the outer surface 132, and a peripheral surface 134 extending between the inner and outer surfaces 132, 133. The cap 130 has a connecting feature 135. Specifically, the connecting feature 135 is a groove 135 is defined on a circumference of the peripheral surface 134, proximate to the outer surface 132. As will be described below, the groove 135 is configured to receive the lip 124 of the receptacle 120. In this embodiment, the cap body 131 is made of a material more rigid than the material of the receptacle body 121.

In this embodiment, to close the receptacle cavity 122 with the cap 130, the cap 130 is received in the receptacle cavity 122. The peripheral surface 134 abuts the lip 124, and causes the lip 124 to elastically deform until the cap 130 is pushed deep enough into the receptacle 120 so that the groove 135 is aligned with the lip 124, at which point the lip 124 returns to its initial shape and position. The lip 124 can prevent the cap 130 from accidentally being removed from the receptacle cavity 122 by engaging with the peripheral surface 134. In other words, there is a mechanical interlock between the receptacle 120 and the cap 130.

In some embodiments, the lip 124 could be initially non-existent, and would be formed by an interference between the cap 130 and the receptacle 120. In order words, in such embodiments, the receptacle 120 does not initially have the lip 124, although the cap body 131 still defines the groove 135. As the cap 130 is forced into the receptacle cavity 122, the interference fit therebetween elastically deforms the material of the receptacle body 121 laterally (i.e., material from the internal surface 125 is compressed toward the peripheral surface) to receive the peripheral surface 134 of the cap 130 within the receptacle cavity 122. Eventually, once the cap 130 is sufficiently inserted into the receptacle cavity 122, the material of the receptacle body 121 returns toward its initial shape and position and generally occupies the groove 135, thereby forming the lip 124.

It is contemplated that in other embodiments, the mechanical interlock between the receptacle 120 and the cap 130 could be inversed such that the cap body 131 would be made of a resilient material so that it can elastically deform to a certain amount without breaking, whereas the receptacle body 121 is made of a more rigid material than the material of the cap body 131. The cap body 131 has the lip 124 which extends radially outwardly therefrom, and the receptacle body 121 defines the groove 135, which extends inwardly therefrom.

A method for manufacturing the hockey puck 101 will now be described.

The method includes providing the receptacle 120.

The method includes molding the body 110 over the receptacle 120 such that receptacle cavity 122 is flush with one of the top and bottom surfaces 111, 112 of the body 110;

The method includes inserting and securing the tracking device 140 in the receptacle cavity 122. In some embodiments, the tracking device 140 could be secured to the receptacle body 321 in the receptacle cavity 122 via an adhesive. Other ways of securing the tracking device 140 to the receptacle 120 are contemplated.

The method includes providing the cap 130.

The method includes closing the receptacle cavity 122 with the cap 130 as described hereabove, so by inserting the cap 130 into the receptacle cavity 122, until a portion of the receptacle body 121 snaps in the groove 135.

It is understood that the above-mentioned steps could be performed in variety of order. Additionally, the method could include more or fewer steps than those described herewith.

Second Embodiment

Figure 4:
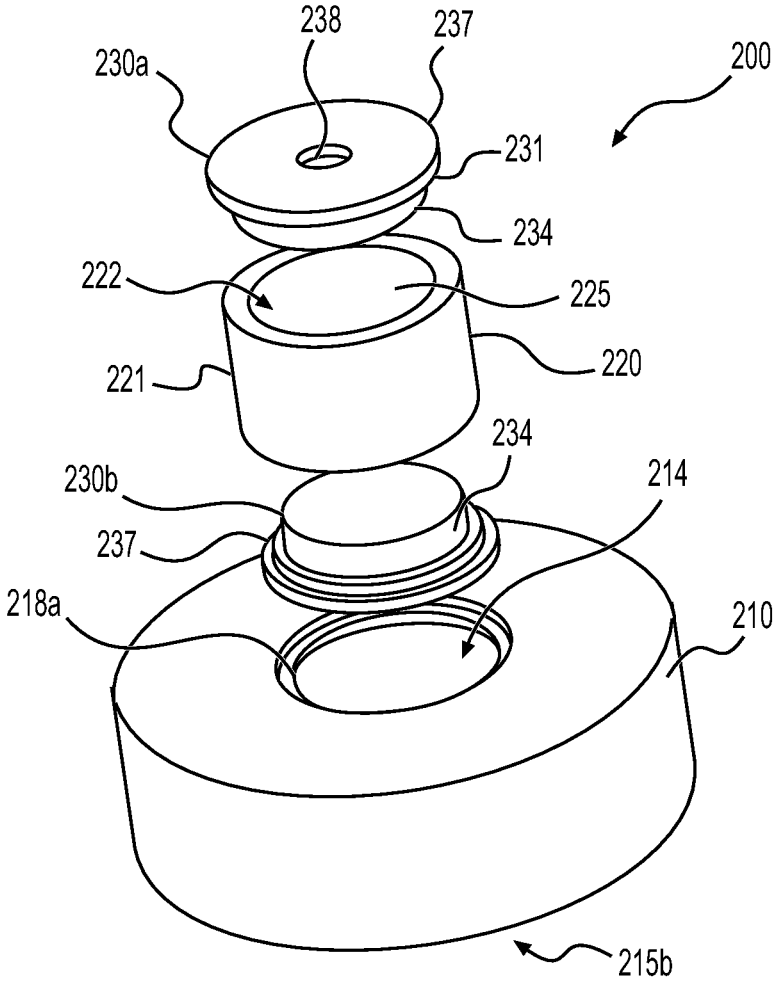
FIG. 4 is a perspective view taken from a top of a puck according to an alternative embodiment of the present technology.
Figure 5:
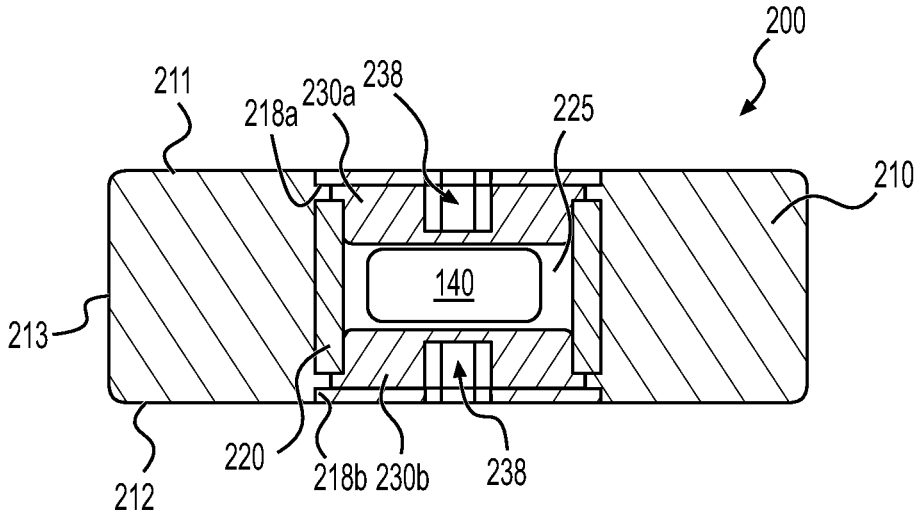
FIG. 5 is a cross-sectional view taken along a center plane of the puck of FIG. 4.

Now referring to FIGS. 4 and 5, a second embodiment of the hockey puck 100 according to the present technology, namely hockey puck 200, will be described. For conciseness, features of the hockey puck 200 similar to those of the hockey pucks 100, 101 will not be described in detail herewith.

The hockey puck 200 has a body 210, a receptacle 220, an upper cap 230*a*, a lower cap 230*b*, and a tracking device 140.

In this embodiment, the body 210 defines a body aperture 214 that is a through aperture (i.e., the body aperture 214 extends axially from a top surface 211 of the body 210 to a bottom surface 212 of the body 210). The body aperture 214 is configured to, in part, receive the receptacle 220 therein. Within the body aperture 214, the body 210 defines an upper recess 218*a* proximate to the top surface 211, and a lower recess 218*b* proximate to the bottom surface 212.

Turning now to the receptacle 220, a receptacle body 221 of the receptacle 220 defines an aperture 222 that is a through aperture. The aperture 222 is configured to receive the upper and lower caps 230*a*, 230*b* therein. An internal surface 225 of the receptacle body 221 is threaded.

Each of the upper and lower caps 230*a*, 230*b* includes a cap body 231 having a threaded portion 234 configured to mate with the threaded internal surface 225. Each of the cap body 231 also has a flanged portion 237. The flanged portion 237 of the upper cap 230*a* is configured to fit in the recess 218*a*, and the flanged portion 237 of the lower cap 230*b* is configured to fit in the recess 218*b*. Each of the caps 230*a*, 230*b* further has a screw drive 238 that is configured to be driven by a tool such as a screwdriver or an alley key. The screw drives 238 are hexagonal apertures in the present embodiment. The screw drive 238 enables one to rotate the cap body relative to the receptacle 220 and to connect the threaded connection with the receptacle body 221.

A method for manufacturing this embodiment of the hockey puck 200 will now be described.

The method includes providing the receptacle 220.

The method includes molding the body 210 over the receptacle 220. The body 210 is molded over the receptacle 220 such that receptacle aperture 224 is not covered on either end thereof.

The method includes inserting and securing the tracking device 240 in the receptacle cavity 222. In some embodiments, the tracking device 140 could be secured to the receptacle body 221 in the receptacle cavity 222 via an adhesive. Other ways of securing the tracking device 140 to the receptacle 220 are contemplated.

The method also includes providing the upper and lower caps 230*a*, 230*b*.

The method also includes closing an upper end of the receptacle aperture 224 with the upper cap 230*a*. This can be done by rotating the upper cap 230*a* by the screw drive 238 via a tool such as an Allen key. Thus, the upper cap 230*a* is threadedly connected to the receptacle 220. The upper cap 230*a* is rotated until the flanged portion 237 of the upper cap 230*a* is received in the upper recess 218*a* of the body 210.

Similarly, the method also includes closing a lower end of the receptacle aperture 224 with the lower cap 230*b*. This can be done by rotating the lower cap 230*b* by the screw drive 238 via a tool such as an Allen key. Thus, the lower cap 230*b* is threadedly connected to the receptacle 220. The lower cap 230*b* is rotated until the flanged portion 237 of the lower cap 230*b* is received in the lower recess 218*b* of the body 210.

It is understood that the above-mentioned steps can be performed in a variety of orders. Additionally, the method could include more or fewer steps than those described hereabove.

Third Embodiment

Figure 6:
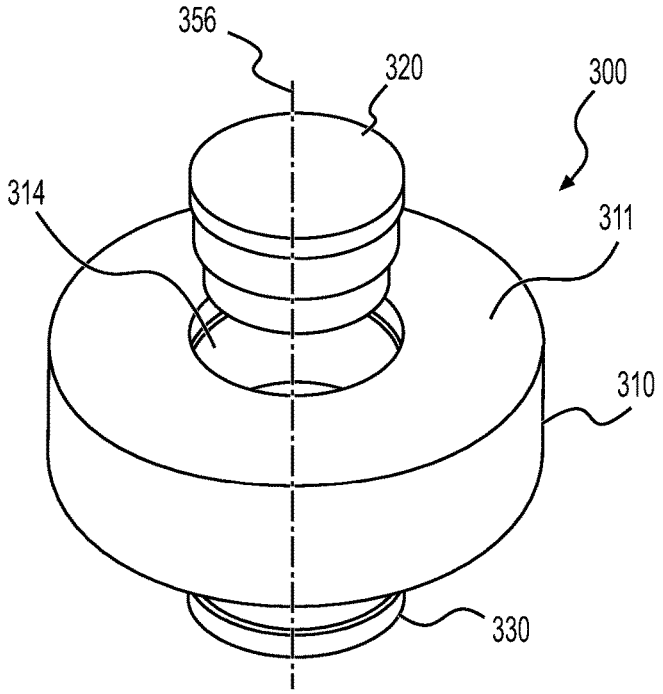
FIG. 6 is a perspective view taken from a top of a puck according to an alternative embodiment of the present technology.
Figure 7:
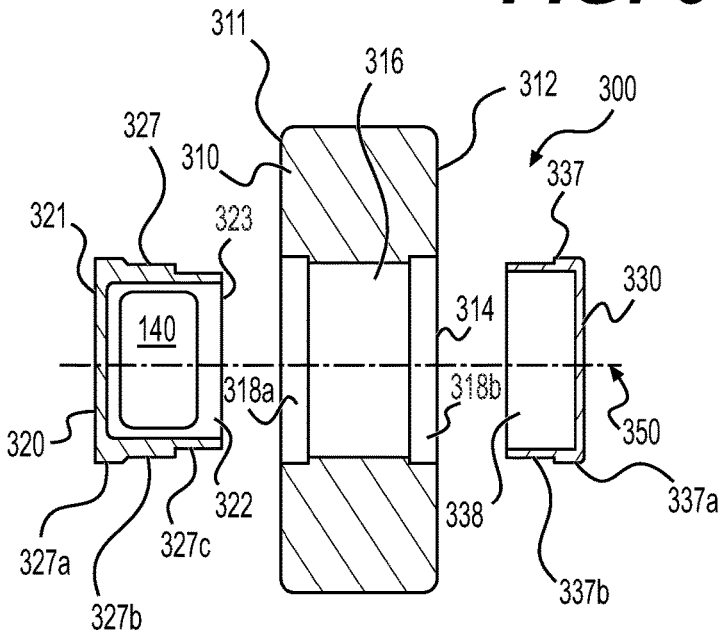
FIG. 7 is an exploded cross-sectional view taken along a center plane of the puck of FIG. 6.
Figure 8:
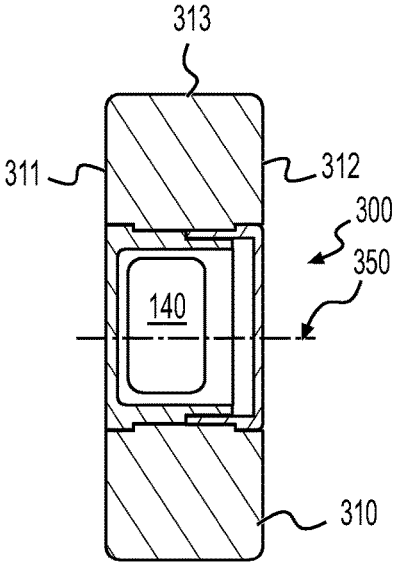
FIG. 8 is a cross-sectional view taken along a center plane of the puck of FIG. 6.

Now referring to FIGS. 6 to 8, a third embodiment of the hockey puck according to the present technology, namely hockey puck 300, will now be described. For conciseness, features of the hockey puck 300 similar to those of the hockey pucks 100, 101, 200 will not be described in detail herewith.

The hockey puck 300 has a body 310, a receptacle 320, a cap 330, and a tracking device 140.

In this embodiment, the body 310 defines a body aperture 314 that is a through aperture (i.e., the body aperture 314 extends axially from a top surface 311 to a bottom surface 312). As will be described below, the body aperture 314 is configured to, in part, receive the receptacle 320 therein. Within the body aperture 314, the body 310 defines a first recess 318*a* proximate to the top surface 311, and a second recess 318*b* proximate to the bottom surface 312.

The receptacle 320 has a receptacle body 321 that is generally cup-shaped. The receptacle body 321 defines a receptacle cavity 322 that is configured to receive the tracking device 140 therein. The receptacle body 321 has an internal surface 325, and an external surface 327, which includes a first portion 327*a*, a second portion 327*b*, and a third portion 327*c*. A radial thickness of the first portion 327*a* is greater than a radial thickness of the second portion 327*b* and the third portion 327*c*, and the radial thickness of the second portion 327*b* is greater than the radial thickness of the third portion 327*c*. The first portion 327*a* is configured to be received in the first recess 318*a*.

In this embodiment, the cap 330 has a cap body 331 that is generally shaped like a cup. The cap body 331 defines a cap cavity 338, which, as will be described below, is configured to at least partially receive part of the receptacle 320 therein. An external surface 337 of the cap 330 has a first portion 337*a* and a second portion 337*b*. A radial thickness of the first tracking portion 337*a* is greater than a radial thickness of the second portion 337*b*. The first portion 337*a* is configured to be received in the recess 318*b*.

To assemble the puck 300, the receptacle body 321 is received in the body aperture 314, until the first portion 327*a* is received in the recess 318*a*. At this stage, the receptacle body 321 is generally flush with the upper surface 311 of the body 310.

Similarly, the cap body 312 is received in the body aperture 314, until the first portion 337*a* is received in the recess 318*b*. At this stage, the cap body 331 is generally flush with the upper surface 311 of the body 310.

Additionally, the receptacle body 321 is configured to be partially received in cap body 331. More precisely, the third portion 327c of the receptacle body 321 is configured to be received within the cap cavity 338, and is configured to be tightly surrounded by the second portion 337*b* of the cap body 331. The interference therebetween provides connection between the receptacle 320 and the cap 330.

In this embodiment, the receptacle body 321 and the cap body 331 are made of a similar material (e.g., plastic) such that they can be joined together by ultrasonic welding.

A method of manufacturing the hockey puck 300 will now be described.

The method includes providing the body 310, the receptacle 320 and the cap 330.

The method includes inserting and securing the tracking device 140 within the receptacle cavity 322. In some embodiments, the tracking device 140 could be secured to the receptacle body 321 in the receptacle cavity 322 via an adhesive. Other ways of securing the tracking device 140 to the receptacle 320 are contemplated.

The method includes receiving part of the cap 330 in the body aperture 314.

The method also includes closing the receptacle 320 by connecting the receptacle body 321 to the cap body 331 via a male-female mating connection.

It is understood that the above-mentioned steps can be performed in a variety of orders. Additionally, the method could include more or fewer steps than those described hereabove.

Fourth Embodiment

Now referring to FIGS. 9 and 10, a fourth embodiment of the hockey puck according to the present technology, namely hockey puck 400, will be described. For conciseness, features of the hockey puck 400 similar to those of the hockey pucks 100, 101, 200, 300 will not be described in detail herewith.

The hockey puck 400 has a body 410, a receptacle 420, a cap 430, and a tracking device 140.

In this embodiment, the body 410 includes a first half 410*a* and a second 410*b*, which are identical. In some embodiments, the first and second halves 410*a*,410*b* can be different. It is contemplated that in other embodiments, the body 410 could be made of three or more parts. The first half 410*a* has a top surface 411 that is generally flat and a mating surface 419*a*. Likewise, the second half 410*a* has a bottom surface 412 that is generally flat and a mating surface 419*b*. Furthermore, the first half 410*a* defines a body cavity 414*a* that extends axially from the mating surface 419*a* toward the top surface 411, and the second half 410*b* defines a body cavity 414*b* that extends axially from the mating surface 419*b* toward the bottom surface 412.

In this embodiment, the receptacle 420 is similar to the receptacle 320. Thus, the receptacle 420 has a first portion 427*a*, a second portion 427*b* and a third portion 427*c*. The receptacle 420 notably differs from the receptacle 320 in that the third portion 327*c* is threaded.

In this embodiment, the cap 430 is similar to the cap 330. Thus, the cap 430 has a first portion 437*a* and a second portion 437*b*. The cap 430 notably differs from the cap 330 in that the cap cavity 438 is threaded so as to be connectable to the receptacle 420.

The first portion 427*a* of the receptacle body 421 and the first portion 437*a* of the cap body 431 are sized and configured to fit into the body cavities 414*a*, 414*b* 418 of the body 410.

In the present embodiment, the receptacle 420 is embedded in the first half 410*a*, and the cap 430 is embedded in the second half 410*b*. The first and second halves 410*a*, 410*b* can be selectively connected to one another by the threaded connection between the receptacle 420 and the cap 430.

Figure 9:
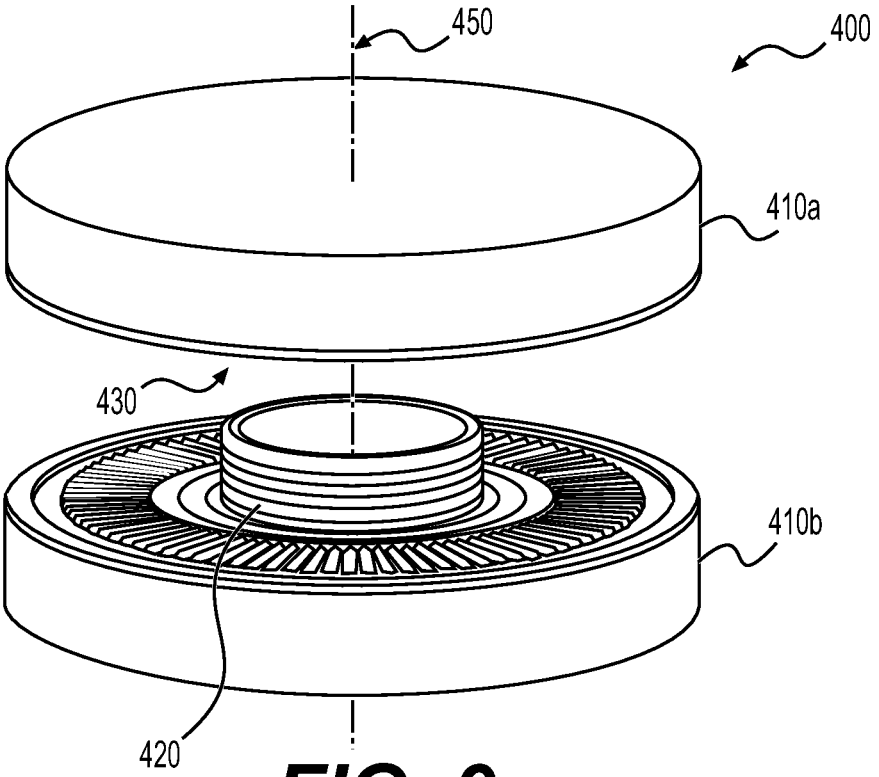
FIG. 9 is a partially exploded perspective view taken from a top of a puck according to an alternative embodiment of the present technology.
Figure 10:
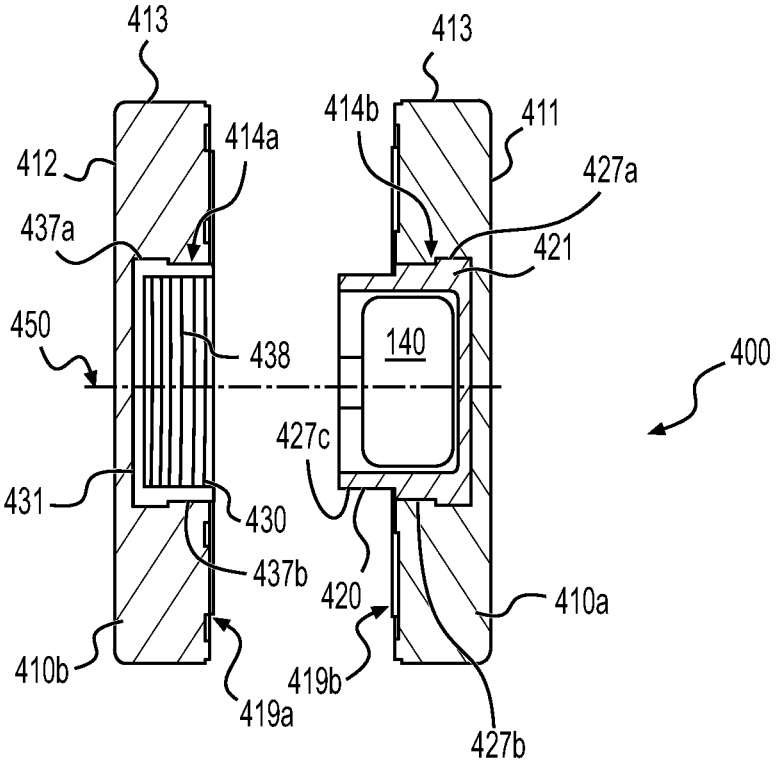
FIG. 10 is an exploded cross-sectional view of view taken along a center plane of the puck of FIG. 9.

In some embodiments, the mating surfaces 419*a*, 419*b* can have a surface finish that is configured to provide a gripping effect between the first and second halves 410*a*, 410*b*, as best seen on FIG. 9. The surface finish can provide mechanical interlocking features such as serrations, grooves and/or ridges that are adapted to increase torque required to rotate the first and second halves 410*a*, 410*b* relative to one another which could result in a separation of the threaded connection between the receptacle 420 and the cap 430, respectively. In other words, the mating surfaces 419*a*, 419*b* could be configured to increase friction when engaged with one another.

It is understood that the male-female thread connection between the receptacle 420 and the cap 430 can be inversed.

A method for manufacturing the hockey puck 400 will now be described.

The method includes providing the receptacle 420 and the cap 430.

The method also includes molding the first half 410*a* of the body 410 over the receptacle 420 such that the first portion 427*c* extends beyond the mating surface 419. Additionally, a receptacle cavity 422 is oriented towards the mating surface 419*a*.

The method also includes inserting and securing the tracking device 140 in the receptacle cavity 422. In some embodiments, the tracking device 140 could be secured to the receptacle body 421 in the receptacle cavity 422 via an adhesive. Other ways of securing the tracking device 140 to the receptacle 420 are contemplated.

The method also includes molding the second half 410*b* of the body 410 over the cap 430 such that the cap 430 is generally flush with the mating surface 419*b*. Additionally, a cap aperture 438 is oriented towards the mating surface 419*b*.

The method also includes aligning the mating surface 419*a* of the first half 410*a* with the mating surface 419*b* of the second half 410*b*.

The method further includes engaging the threaded portion of the cap 430 with the threaded portion of the receptacle 420.

The method also includes rotating the first half 410*a* relative to the second half 410*b* for connecting the cap 430 to the receptacle 420, until the mating surfaces 419 of the first and second halves 410*a*, 410*b* of the body 410 engage one another.

It is to be noticed that since the first and second halves 410*a*,410*b* of the body 410 are overmolded on, respectively, the receptacle 420 and the cap 430, no tool is required for connecting the receptacle 420 and the cap 430.

It is understood that the above-mentioned steps can be performed in a variety of orders. Additionally, the method could include more or fewer steps than those described hereabove.

Fifth Embodiment

Figure 11:
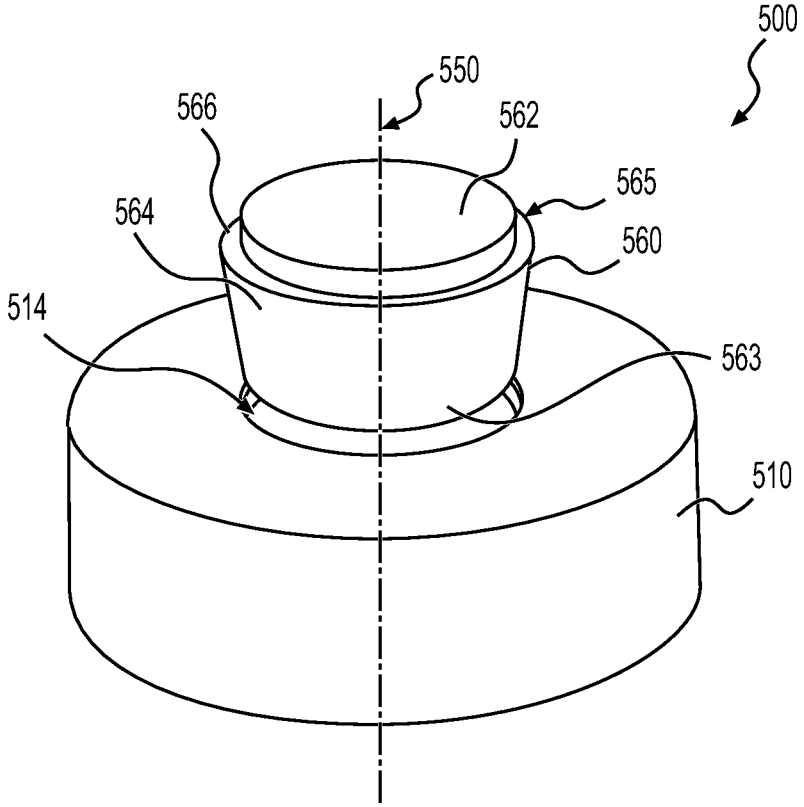
FIG. 11 is a partially exploded perspective view taken from a top of a puck according to an alternative embodiment of the present technology.
Figure 12:
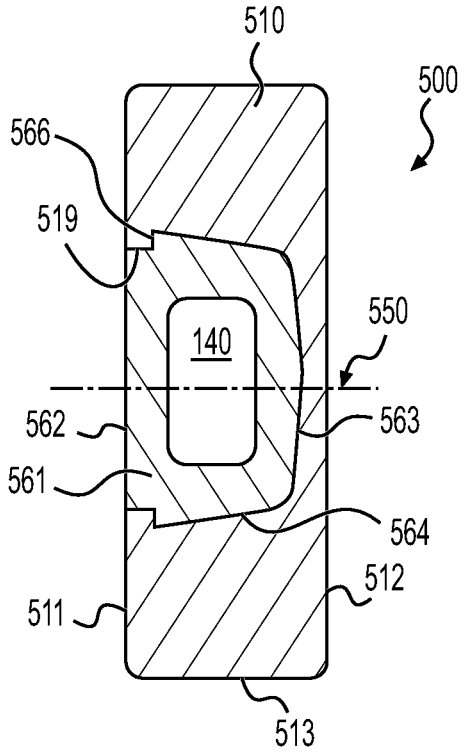
FIG. 12 is a cross-sectional view taken along a center plane of the puck of FIG. 11.

Now referring to FIGS. 11 and 12, a fifth embodiment of the hockey puck according to the present technology, namely hockey puck 500, will be described. For conciseness, features of the hockey puck 500 similar to those of the hockey pucks 100, 101, 200, 300, 400 will not be described in detail herewith.

The hockey puck 500 has a body 510 and a tracking device 140 having an enclosure 560. It is contemplated that in some embodiments, it is the hockey puck 500 which could include the enclosure, and the tracking device 140 would be receivable in the enclosure 560.

The body 510 has a top surface 511, a bottom surface 512 spaced from the top surface 511 and a peripheral surface 513 extending from the top surface 511 to the bottom surface 512. The top and bottom surfaces 511, 522 are generally flat. The body 510 defines an axis 550 that extends through a centre thereof.

The body 510 defines a body cavity 514 that extends axially along the axis 550 from the top surface 511 toward the bottom surface 512. In other embodiments, the body cavity 514 could extend from the bottom surface 512 toward the top surface 511. Within the body cavity 514, the body 510 has a lip 519 that extends radially inwardly.

The body cavity 514 is configured to receive the tracking device 140 and is generally complementary with the enclosure 560. In some embodiments, the body 510 is initially formed with the body cavity 514, and the enclosure 560 is configured to be subsequently fit into the body cavity 514 by having an at least partially complementary shape to the body cavity 514. In other embodiments, the enclosure 560 could be formed first, and then the body 510 could be formed around the enclosure 560 (e.g., via overmolding process), such that the body cavity 514 is formed by surrounding the enclosure 560.

In this embodiment, the enclosure 560 is configured to receive the tracking device 140, and close the body cavity 514 (i.e., act as a cap). The enclosure 560 has an enclosure body 561. The enclosure body 561 defines a top surface 562, a bottom face 563 spaced from the top surface 562, and a peripheral surface 564. A groove 565 is defined in the enclosure body 561 proximate to the top surface 562. The groove 565, which extends radially inwardly from the peripheral surface 564, defines a lip-receiving portion 566. In this embodiment, the peripheral surface 564 is tapered and the bottom face 563 is generally v-shaped so as to ease insertion of the enclosure 560 in the body cavity 514. However, other configurations are contemplated as well.

The enclosure 560 is configured and sized to fit in the body cavity 514. In some embodiments, the enclosure 560 could be oversized compared to the body cavity 514.

A method for manufacturing the hockey puck 500 will now be described.

The method includes providing the body 510 and the tracking device 140 and the enclosure 560. The tracking device 140 is enclosed in the enclosure 560.

The method includes receiving the enclosure 560 and the tracking device 140 in the body cavity 514. Receiving the enclosure 560 in the body cavity 514 causes the lip 519 to elastically deform.

The method further includes pushing the enclosure 560 in the body cavity 514 until the lip 519 is received in the groove 565, and engages the lip-receiving portion 566. At this stage, the lip 519 returns to its initial shape, thereby securing the tracking device 140 in place.

It is understood that the above-mentioned steps can be performed in a variety of orders. Additionally, the method could include more or fewer steps than those described hereabove.

Sixth Embodiment

Figure 13:
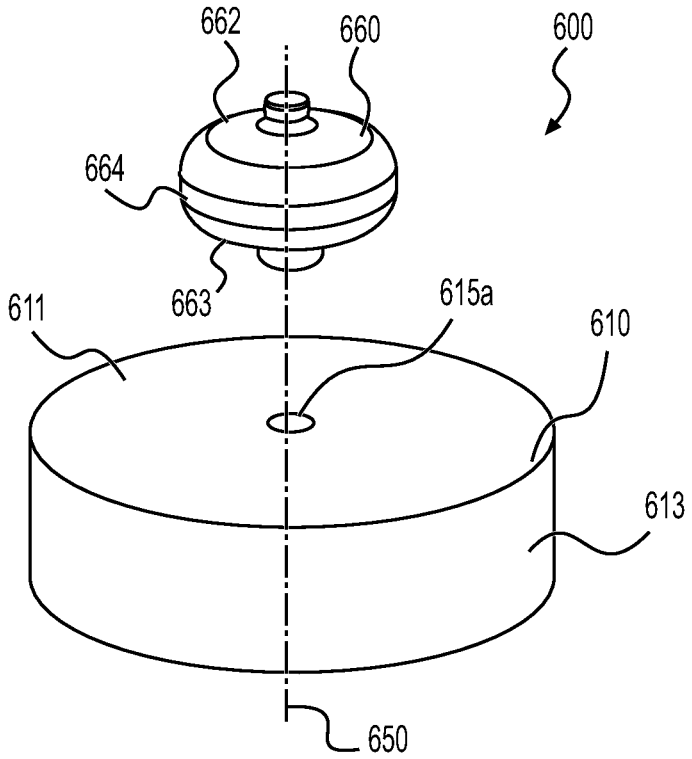
FIG. 13 is a partially exploded perspective view taken from a top of a puck according to an alternative embodiment of the present technology.
Figure 14:
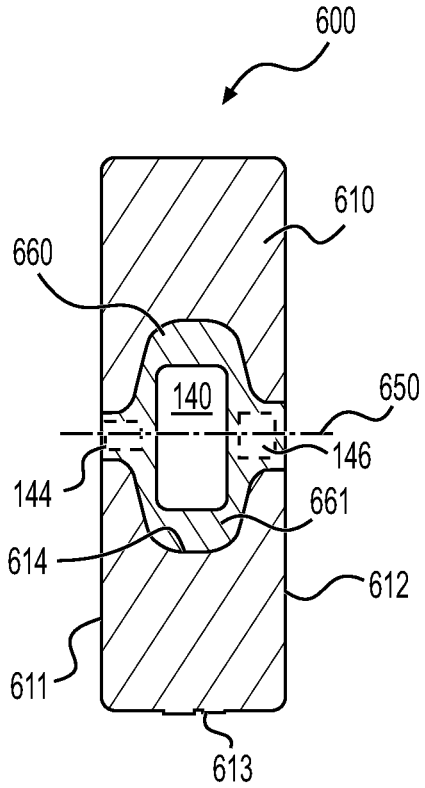
FIG. 14 is a cross-sectional view taken along a center plane of the puck of FIG. 13.

Now referring to FIGS. 13 and 14, a sixth embodiment of the hockey puck according to the present technology, namely hockey puck 600, will be described. For conciseness, features of the hockey puck 600 similar to those of the hockey pucks 100, 101, 200, 300, 400, 500 will not be described in detail herewith.

The hockey puck 600 has a body 610 and a tracking device 140 having an enclosure 660. It is contemplated that in some embodiments, it is the hockey puck 600 which could include the enclosure, and the tracking device 140 would be receivable in the enclosure 660.

In this embodiment, the tracking device 140 includes a charging base 144 for enabling wireless charging of the tracking device 140 by an external charger. As mentioned above with respect to the puck 100, the tracking device 140 also includes the light-emitting device 146.

The enclosure 660 has an enclosure body 661, defining a top surface 662, a bottom surface 663 spaced from the top surface 662, and a peripheral surface 664 extending between the top and bottom surfaces 662, 663. The enclosure body 661 has a custom shape that generally resembles a larger central portion and smaller upper and lower portions (opposite of an hourglass shape). The custom shape can assist in locking movement of the enclosure 660 relative to the body 610. The charging base 144 extends from the bottom surface 663, and the light-emitting device 146 extends from the top surface 662. Other configurations are contemplated as well.

The body 610 has a top surface 611, a bottom surface 612 spaced from the top surface 611, and a peripheral surface 613 between the top and bottom surfaces 611, 612. The body 610 also defines an axis 650.

The body 610 also defines a body aperture 614 that extends axially from the top surface 611 to the bottom surface 612.

The body aperture 614 is configured to receive the tracking device 140 and the enclosure 660 therein. More precisely, the body cavity 614 is complementary to the enclosure 660. As will be described below, the enclosure 660 is formed first, and then the body 610 is formed around the enclosure 660 (e.g., via overmolding process). Thus, the body aperture 614 is formed by surrounding the enclosure 660. Other configurations are contemplated as well.

Since the body aperture 614 extends from the top surface 611 to the bottom surface 612 (i.e., through-aperture), the charging base 144 is proximate to the top surface 611, which enables the charging base 144 to connect with an external charger. Additionally, the body aperture 614 also allows light to come out from the light-emitting device 146.

It is understood that in some embodiments, the body aperture 614 could not be a through-aperture. It is contemplated that in such embodiments, performance of the charger base 144 or the light-emitting device 144 would not be impacted. For instance, the body cavity 614 can be enclosed by the body 610, such that the thickness of the body 610 is reduced to a minimum proximate to a position of the charger base 144 and/or the light-emitting device 146 thereby enabling wireless charging and light emission.

A method for manufacturing the hockey puck 600 will now be described.

The method includes providing the tracking device 140 and the enclosure 660. The tracking device is enclosed in the enclosure 660.

The method also includes molding the body 610 over the enclosure 660 such that the charger base 144 is proximate to the top surface 611 and that the light-emitting device 146 is proximate to the bottom surface 612 of the body 610.

It is understood that the above-mentioned steps can be performed in a variety of orders. Additionally, the method could include more or less steps than those described hereabove.

Seventh Embodiment

Figure 15:
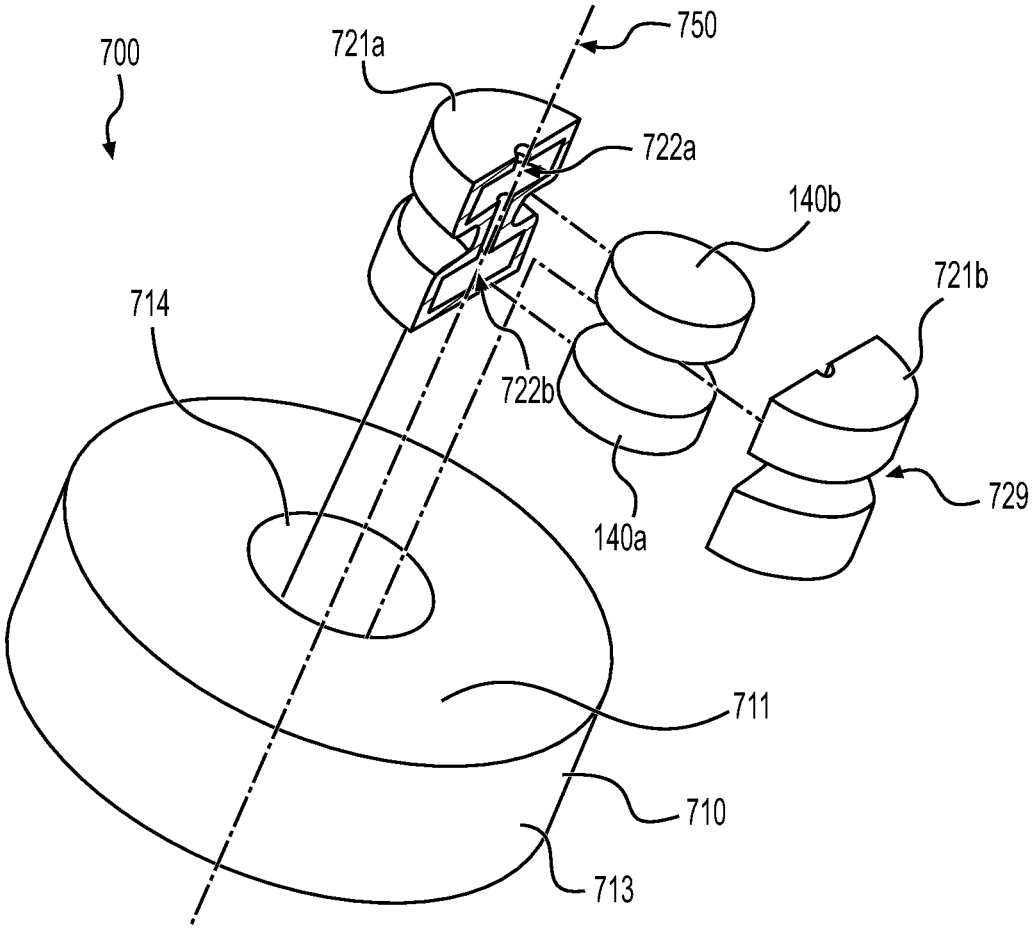
FIG. 15 is an exploded perspective view taken from a top of a puck according to an alternative embodiment of the present technology.
Figure 16:
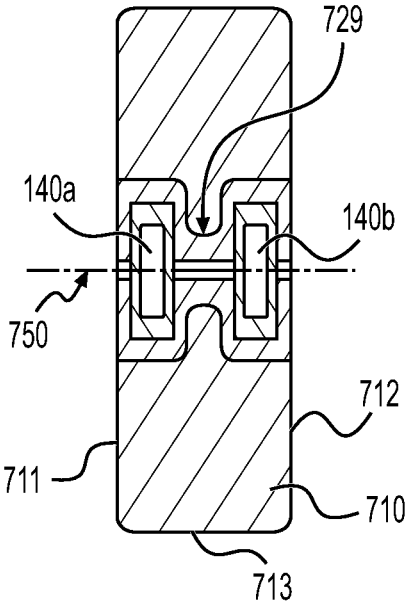
FIG. 16 is a cross-sectional view taken along a center plane of the puck of FIG. 15.

Now referring to FIGS. 15 and 16, a seventh embodiment of the hockey puck according to the present technology, namely hockey puck 700, will be described. For conciseness, features of the hockey puck 700 similar to those of the hockey pucks 100, 101, 200, 300, 400, 500, 600 will not be described in detail herewith.

The hockey puck 700 has a body 710, a receptacle 720, and a tracking device 140.

In this embodiment, the tracking device 140 includes first and second portions 140*a*, 140*b*. The first and second portions 140*a*, 140*b* are separate from one another. In the present embodiment, the first portion 140*a* includes the majority of the components forming the tracking device 140, except the power unit 142 (e.g., battery) which is included in the second portion 140*b* and connected to the other components in the first portion 140*a*. In other words, the first and second portions 140*a*, 140*b* are electronically connected to one another. Other configurations are contemplated as well.

The receptacle 720 is formed of a first receptacle body 721*a* and a second receptacle body 721*b*. The first and second receptacle portions 721*a*, 721*b* are connected to one another, as will be described below, during the manufacturing process of the hockey puck 700, and, together, form the receptacle body 721. In some embodiments, the first and second receptacle bodies 721*a*, 721*b* can be connected to one another by an adhesive. In other embodiments, the first and second receptacle bodies 721*a*, 721*b* could be connected by pressing them towards one another (i.e., via pressure). In some cases, the first and second receptacle portions 721*a*, 721*b* could be made as a unitary piece receptacle body 721 instead of being separate parts. Each of the first and second receptacle bodies 721*a*, 721*b* has a first receptacle cavity 722*a* configured to receive part of the first portion 140*a* and a second receptacle cavity 722*b* configured to receive part of the second portion 140*b*. Each of the first and second receptacle bodies 721*a*, 721*b* are made of an elastomeric material.

The receptacle body 720, when the first and second receptacle bodies 721*a*, 721*b* are connected to one another, has an hour-glass shape. Thus, the receptacle body 720 defines a central groove 729. The central groove 729 provides a mechanical interlocking connection with the body 710. It is contemplated that the receptacle body 720 could be shaped differently.

In this embodiment, the body 710 has a top surface 711, a bottom surface 712 spaced from the top surface 711, and a peripheral surface 713 extending between the top and bottom surfaces 711, 712. The body 710 defines an axis 750 that extends at centre thereof.

The body 710 defines a body aperture 714 that extends axially along the axis 750 from the top surface 711 to the bottom surface 712. The body aperture 714 is configured to receive the receptacle 720 and the tracking device 140 therein. Specifically, the body aperture 714 is complementary with the receptacle 720.

A method for manufacturing the hockey puck 700 will now be described.

The method includes providing the first and second portions 140*a*,140*b* of the tracking device 140, and the first and second portions 721*a*, 721*b* of the receptacle 720.

The method includes receiving the first and second portions 140*a*, 140*b* of the tracking device 140 in, respectively, the first and second receptacle cavities 722*a*, 722*b*.

Then, the first and second portions 721*a*, 721*b* of the receptacle 720 are connected to one another, thereby enclosing the tracking device 140 within the receptacle 720.

The method then includes molding the body 710 over the receptacle 720.

It is understood that the above-mentioned steps can be performed in a variety of orders. Additionally, the method could include more or fewer steps than those described hereabove.

Eighth Embodiment

Figure 17:
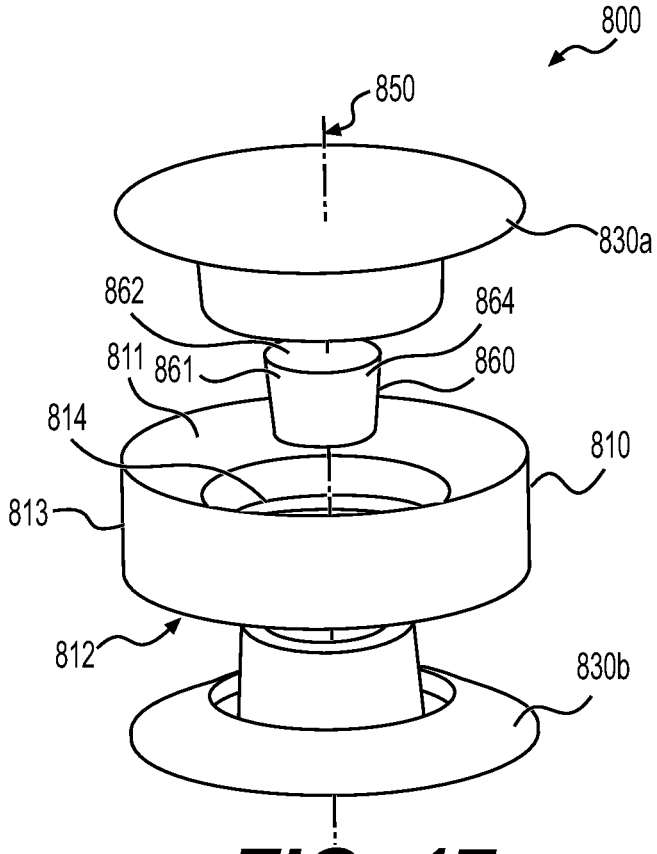
FIG. 17 is an exploded perspective view taken from a top of a puck according to an alternative embodiment of the present technology.
Figure 18:
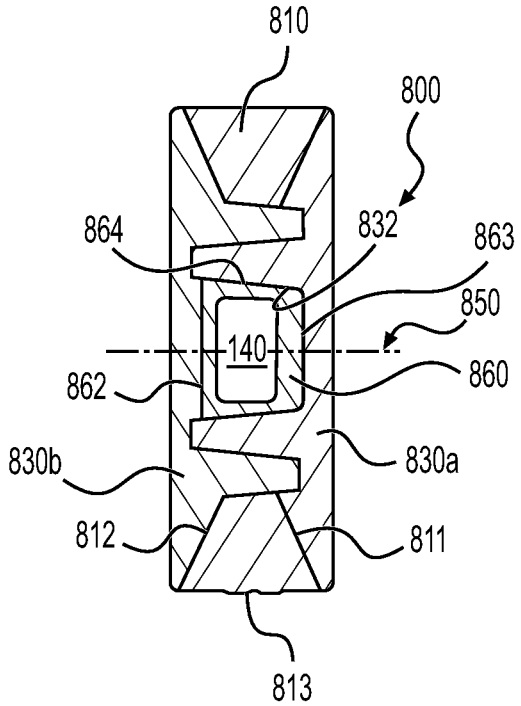
FIG. 18 is a cross-sectional view taken along a center plane of the puck of FIG. 17.
Figure 19:
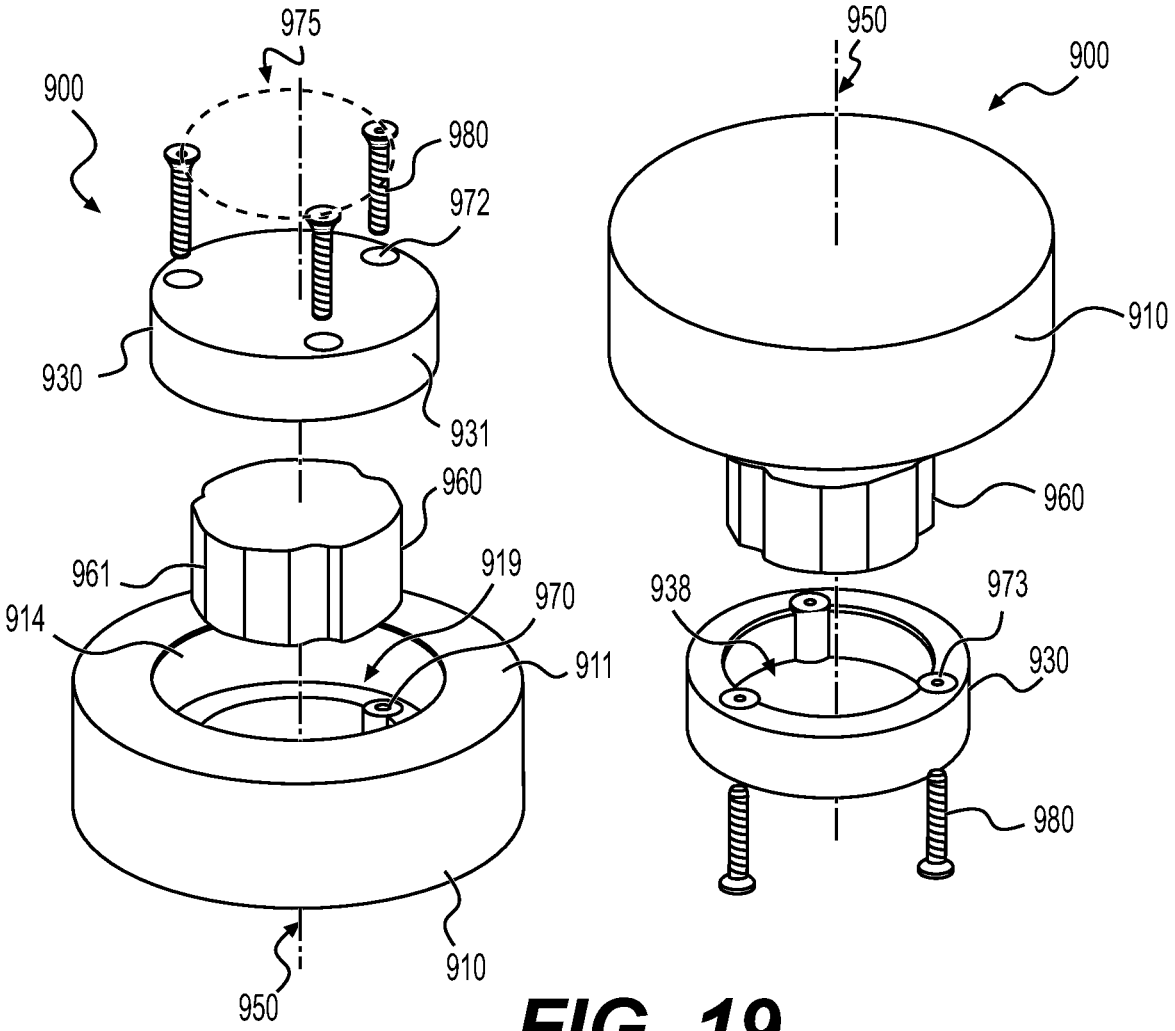
FIG. 19 is an exploded perspective view of a puck according to an alternative embodiment of the present technology.

Now referring to FIGS. 17 and 18, an eighth embodiment of a hockey puck according to the present technology, namely hockey puck 800, will be described. For conciseness, features of the hockey puck 800 similar to those of the hockey pucks 100, 101, 200, 300, 400, 500, 600, 700 will not be described in detail herewith.

The hockey puck 800 has a body 810, a first cap 830*a*, a second cap 830*b*, and a tracking device 140 having an enclosure 860. In some embodiments, the hockey puck 800 could include the enclosure in which the tracking device 140 could be disposed.

The body 810 has a beveled top surface 811, a beveled bottom surface 812 spaced from the beveled top surface 811, and a peripheral surface 813 extending between the beveled bottom and top surfaces 812, 811. The body 810 also defines an axis 850 that extends through a centre of the body 810.

The body 810 defines a body aperture 814 extends axially along the axis 850 from the beveled top surface 811 to the beveled bottom surface 812 (i.e., the body aperture 814 is a through-aperture).

The body aperture 814 is configured to receive part of the first cap 830*a* therein. The body aperture 814 is generally complementary with the first cap 830*a*. In some embodiments, the body 810 could be initially formed with a body cavity 814, and the first cap 830*a* would be configured to fit into the body cavity 814 by having an at least partially complementary shape to the body cavity 814. In other embodiments, the first cap 830*a* could be formed first, and the body 810 could be formed subsequently, around the first cap 830*a* (e.g., via overmolding process). As such the body cavity 814 could be formed by surrounding the first cap 830*a*.

The first and second caps 830*a*, 830*b* are made of the same material as the body 810, but can differ in terms of color. In some embodiments, the first and second caps 830*a*, 830*b* could be made of different material than that of the body 810. The first and second caps 830*a*, 830 are configured to mechanically interlock each other via a male-female connection, or another equivalent feature such as, for example, threads. The first cap 830*a* is configured to close one end of the body aperture 814 by mating with the top beveled surface 811 and the second cap 830*b* is configured to close the other end of the body aperture 814 by mating with the bottom beveled surface 812. Thus, the body 810 is generally sandwiched therebetween.

In addition, the first cap 830*a* defines a cap cavity 832 adapted to receive the tracking device 140 therein.

The tracking device 140 is enclosed in, and protected by, the enclosure 860, which has an enclosure body 861. The enclosure body 861 defines a top surface 862, a bottom surface 863 spaced from the top surface 862, and a peripheral surface 864 extending between the top and bottom surfaces 862, 863. In this embodiment, the peripheral surface 864 is tapered, which can ease insertion of the enclosure 860 in the cap cavity 832. It is contemplated that in other embodiments the tracking device 140 could be shaped differently.

A method for manufacturing the hockey puck 800 will now be described.

The method includes providing the body 810, the first and second caps 830*a*, 830*b* and the tracking device 140 which is enclosed in the enclosure 860.

The method also includes inserting and securing the tracking device 140 in the cap cavity 832 of the first cap 830*a*. In some embodiments, the tracking device 140 could be secured to the first cap 830*a* in the cap cavity 832 via an adhesive. Other ways of securing the tracking device 140 to the first cap 830*a* are contemplated.

The method also includes inserting the first cap 830*a* in the body aperture 814, thereby closing one end thereof.

The method also includes inserting the second cap 830*b* in the body aperture 815, thereby closing the other end thereof. Thus, the tracking device 140 is disposed between the first and second caps 830*a*, 830*b*.

The method also includes mechanically interlocking the first cap 830*a* to the second cap 830*b*. In some embodiments, this can be done via a threaded connection. In other embodiments, this can be done by a press-fit connection.

It is understood that the above-mentioned steps can be performed in a variety of orders. Additionally, the method could include more or fewer steps than those described hereabove.

Ninth Embodiment

Now referring to FIGS. 19 to 22, a ninth embodiment of a hockey puck according to the present technology, namely hockey puck 900, will be described. For conciseness, features of the hockey puck 900 similar to those of the hockey pucks 100, 101, 200, 300, 400, 500, 600, 700, 800 will not be described in detail herewith.

The hockey puck 900 has a body 910, a plurality of threaded inserts 970, a cap 930, and a tracking device 140 received in, and protected by, an enclosure 960.

In this embodiment, the body 910 has a top surface 911, a bottom surface 912 spaced from the top surface 911 and a peripheral surface 913 extending between the top and bottom surfaces 911, 912. The body 910 defines an axis 950 that extends at a centre thereof.

A body cavity 914 extends along the axis 950 from the top surface 911 toward the bottom surface 912. It is contemplated that in other embodiments, the body cavity 914 could extend from the bottom surface 912 toward the top surface 911. Within the body cavity 914, the body 910 defines a recess 919 that extending radially outwardly. In other words, at one vertical point along the axis 950, from the top surface 911 until a bottom of where the recess 919 is defined, the body cavity 914 has a first radius, and below the bottom of where the recess 919 is defined until a bottom of the body cavity 914, the body cavity 914 has a second radius that is smaller than the first radius. It is contemplated that the radii could vary from one embodiment to another. As will be described below, the recess 919 of the body 910 is configured to receive at least a portion of the cap 930 therein.

The body cavity 914 is configured to receive at least part of the enclosure 960, and as such, at least part of the tracking device 140. The body cavity 914 is generally complementary with the enclosure 960. In some embodiments, the body 910 could initially be formed with a body cavity 914, and the enclosure 960 could subsequently be formed to fit into the body cavity 914 by having an at least partially complementary shape to the body cavity 914. In other embodiments, the enclosure 960 could be formed first, and the body 910 could subsequently be formed around the enclosure 960 (e.g., via overmolding process), such that the body cavity 914 is formed by surrounding the enclosure 960. Other configurations are contemplated as well.

The cap 930 has a cap body 931 that defines a cap cavity 938. The cap cavity 938 is configured to receive at least part of the enclosure 960, and as such, at least part of the tracking device 140. The cap cavity 938 is generally complementary with the enclosure 960. In some embodiments, the cap 930 is initially formed first with a cap cavity 938, and the enclosure 960 could subsequently be formed to fit into the cap cavity 938 by having an at least partially complementary shape to the cap cavity 938. In other embodiments, the enclosure 960 could be formed first, and the cap 930 could subsequently be formed around the enclosure 960 (e.g., via overmolding process), such that the cap cavity 938 is formed by surrounding the enclosure 960. Other configurations are contemplated as well.

Figure 20:
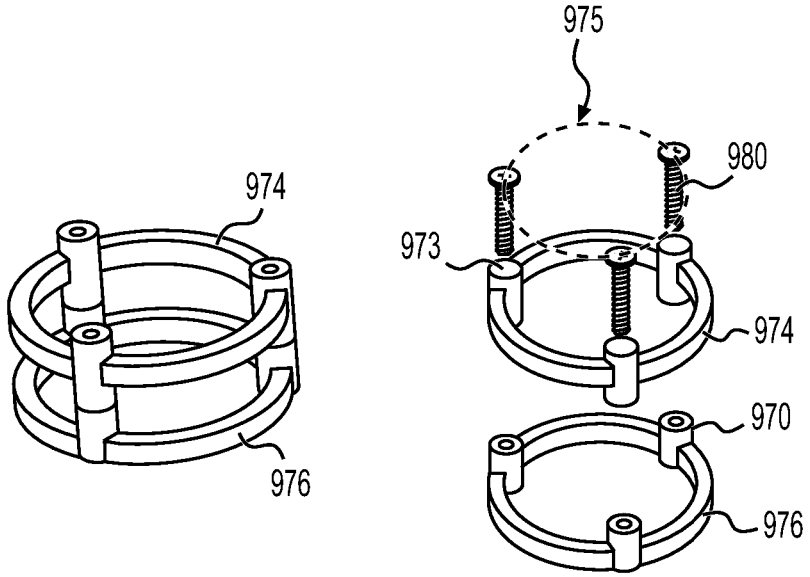
FIG. 20 is an exploded perspective view of a sleeve and fasteners of the puck of FIG. 19.
Figure 21:
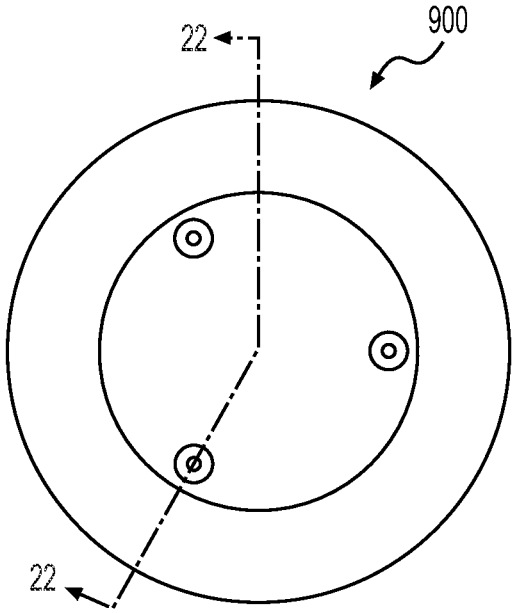
FIG. 21 is a top plan view of the puck of FIG. 19.
Figure 22:
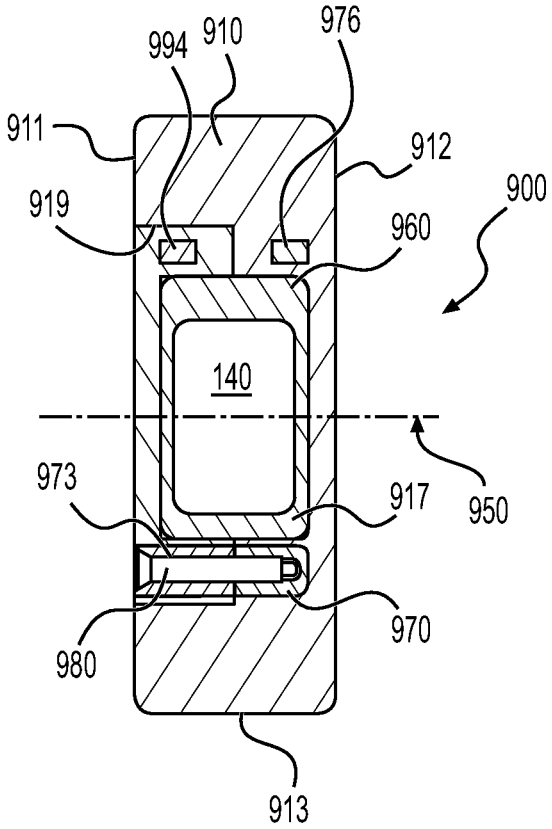
FIG. 22 is a cross-sectional view of the puck of FIG. 19 taken along the line 22-22 of FIG. 21.

The cap body 931 also defines a plurality of fastener openings 972 extending therethrough, and arranged in a fastening array 975 about the axis 950. In some embodiments, the plurality of fastener openings 972 could include sleeves 973. In some embodiments, the sleeves 973 are interconnected to one another by a sleeve body 974, as best seen in FIG. 20. The sleeve body 974 further serves as structural reinforcement to the cap 930. The sleeves 973 and/or the sleeve body 974 can be made of various suitable material such as plastic, or metal.

Furthermore, a plurality of threaded inserts 970 are integrated in the body 910 and are arranged to mate with the fastening array 975 of the cap 930. In some embodiments, the threaded inserts 970 are connected to each other by a threaded insert body 976, which also serves as structural reinforcement to the body 910. The threaded inserts 970 and/or the threaded insert body 976 can be made of various suitable material such as plastic, or metal.

When the cap 930 is inserted in the body cavity 914, a plurality of fasteners 980 are used to connect the cap 930 to the body 910, wherein the fasteners 980 are received through the fastener openings 972 (or the sleeves 973, if applicable) of the cap 930 before engaging in the threaded inserts 970 embedded in the body 910.

A method for manufacturing the hockey puck 900 will now be described.

The method includes providing the body 910 with embedded threaded inserts 976, the tracking device 140 which is enclosed in the enclosure 960, and the cap 930 with the fastener openings 972.

The method also includes inserting and securing the tracking device 140 in the body cavity 914 of the body 910. In some embodiments, the tracking device 140 could be secured to the body 910 in the body cavity 914 via an adhesive. Other ways of securing the tracking device 140 to the body 910 are also contemplated.

The method also includes closing the open end of the body aperture 914 with the cap 930.

The method also includes aligning the fastener openings 972 of the cap 930 with the threaded inserts 976 of the body 910.

The method also includes connecting the cap 930 and the body 910 by fastening the fasteners to the cap 930 and the body 910.

It is understood that the above-mentioned steps can be performed in a variety of orders. Additionally, the method could include more or fewer steps than those described hereabove.

Tenth Embodiment

Figure 23:
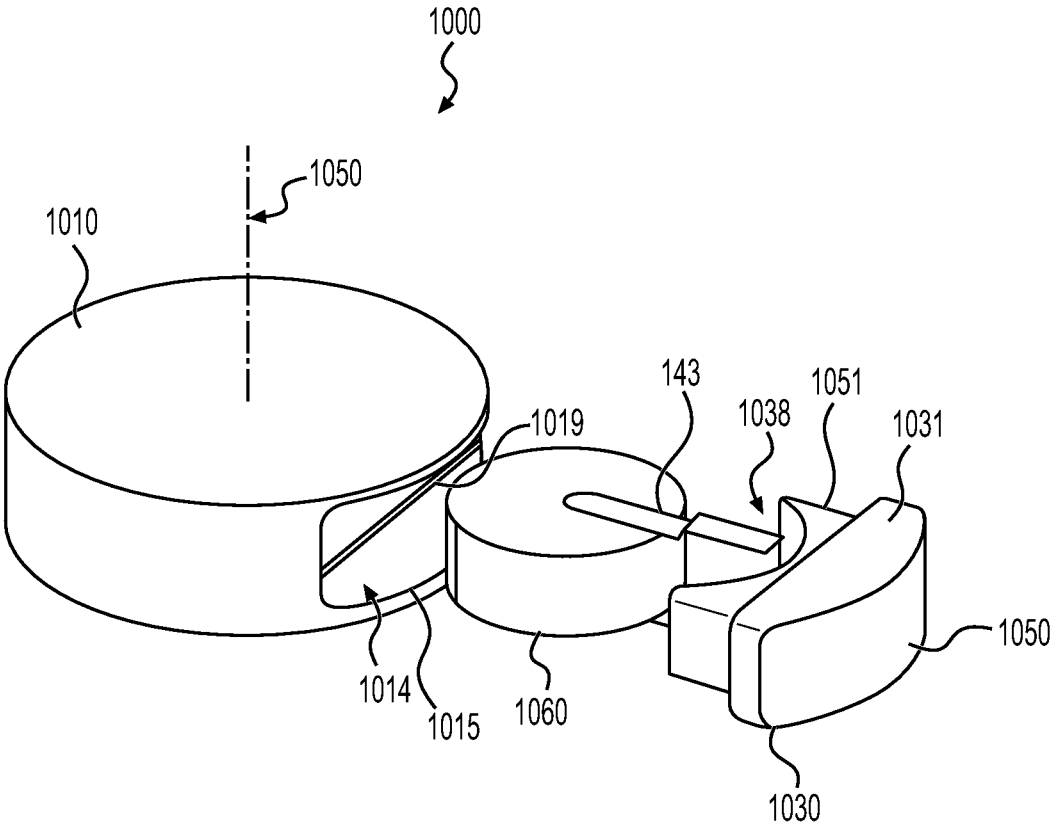
FIG. 23 is an exploded perspective view taken from a top of a puck according to an alternative embodiment of the present technology.
Figure 24:
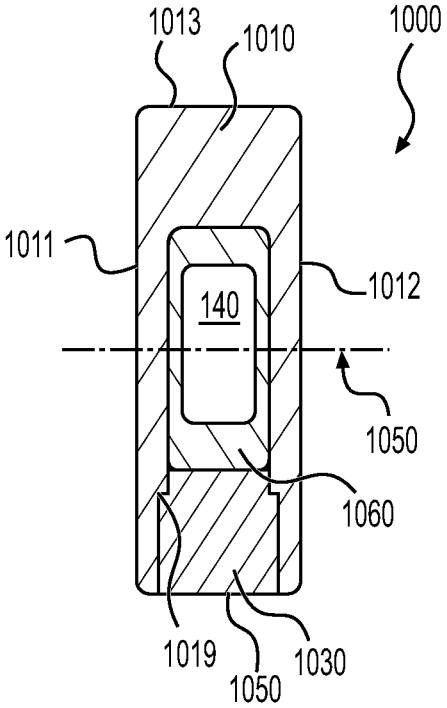
FIG. 24 is a cross-sectional view taken along a center plane of the puck of FIG. 23.

Now referring to FIGS. 23 and 24, a tenth embodiment of a hockey puck according to the present technology, namely hockey puck 1000, will be described. For conciseness, features of the hockey puck 900 similar to those of the hockey pucks 100, 101, 200, 300, 400, 500, 600, 700, 800, 900 will not be described in detail herewith.

The hockey puck 1000 has a body 1010, a cap 1030, and a tracking device 140 received in, and protected by, an enclosure 1060.

The body 1010 has a top surface 1011, a bottom surface 1012 spaced from the top surface 1011, and a peripheral surface 1013 extending between the top and bottom surfaces 1011, 1012. The top and bottom surfaces 1011, 1012 are generally flat. The body 1010 also defines an axis 1050 that extends at a centre thereof.

The body 1010 defines a body cavity 1014 that extends radially inwardly from the peripheral surface 1013. Within the body cavity 1014, the body 1010 defines a recess 1019.

The body cavity 1014 is configured to receive at least part of the enclosure 1060, and thus, at least a part of the tracking device 140. The body cavity is generally complementary with the enclosure 1060. In some embodiments, the body 1010 could initially be formed with a body cavity 1014, and the enclosure 1060 could subsequently be formed to fit into the body cavity 1014 by having an at least partially complementary shape to the body cavity 1014. In other embodiments, the enclosure 1060 could be formed first, and the body 1010 could be formed subsequently around the enclosure 1060 (e.g., via overmolding process), such that the body cavity 1014 is formed by surrounding the enclosure 1060. Other configurations are contemplated as well.

The cap 1030 has a cap body 1031 having a peripheral portion 1050 and a protruding portion 1051. The peripheral portion 1050 is configured to complete the peripheral portion 1013 of the body 1010 when the cap 1030 is connected to the body 1010. The protruding portion 1051 defines a cap cavity 1038 configured to receive at least part of the enclosure 1060, and thus, at least part of the tracking device 140, therein. The cap cavity 1038 is generally complementary with the enclosure 1060. In some embodiments, the cap 1030 could initially be formed with the cap cavity 1038, and the enclosure 1060 could subsequently be formed so as to fit into the cap cavity 1038 by being at least partially complementary to the cap cavity 1038. In other embodiments, the enclosure 1060 could initially be formed, and the cap 1030 could subsequently be formed around the enclosure 1060 (e.g., via overmolding process), such that the cap cavity 1038 is formed by surrounding the enclosure 1060. Other configurations are contemplated as well. In addition, to receive at least part of the enclosure 1060 and the tracking device 140, the protruding portion 1051 is configured to close the body cavity 1014 until the protruding portion 1051 is in contact with the recess 1019 (i.e., similarly to a drawer).

In this embodiment, the tracking device 140 includes the external antennae 143 to enhance radio-frequency transmission of the tracking device 140.

A method of manufacturing the hockey puck 100 will now be described.

The method includes providing the body 1010, the tracking device 140 which is enclosed in the enclosure 1060, and the cap 1030.

The method also includes inserting and securing the tracking device 140 in the body cavity 1014 of the body 1010. In some embodiments, the tracking device 140 could be secured to the body 1010 in the body cavity 1014 via an adhesive. Other ways of securing the tracking device 140 to the body 1010 are also contemplated.

The method also includes closing the open end of the body cavity 1014 with the cap 1030.

The method also includes connecting the cap 1030 to the body 1010. This could be done in a variety of ways, such as with an adhesive or a fastener.

It is understood that the above-mentioned steps can be performed in a variety of orders. Additionally, the method could include more or fewer steps than those described hereabove.

Eleventh Embodiment

Figure 25:
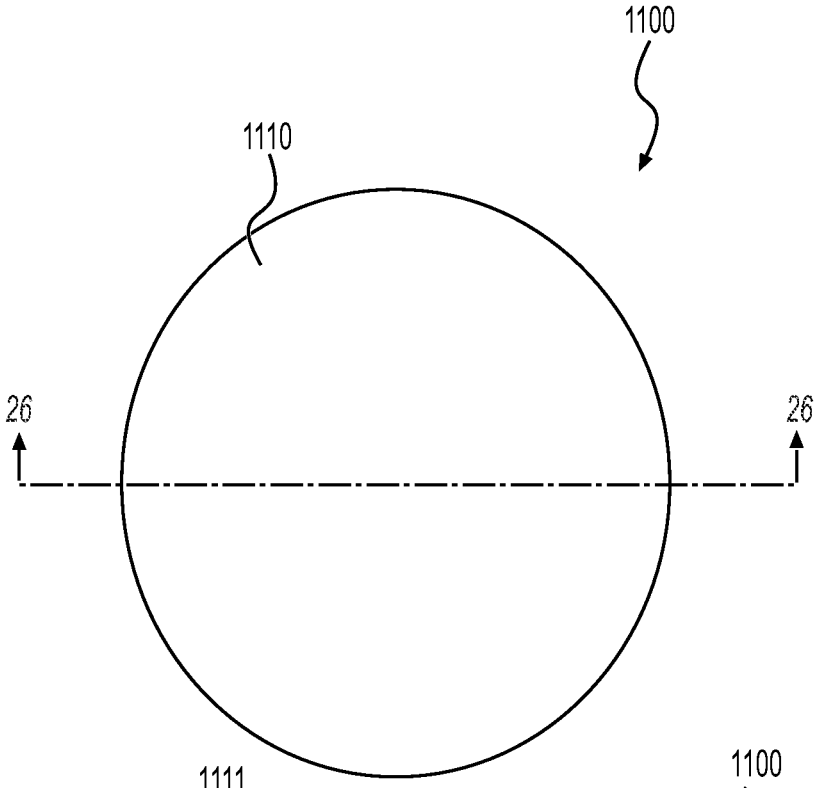
FIG. 25 is a top plan view of a puck according to an alternative embodiment of the present technology.
Figure 26:
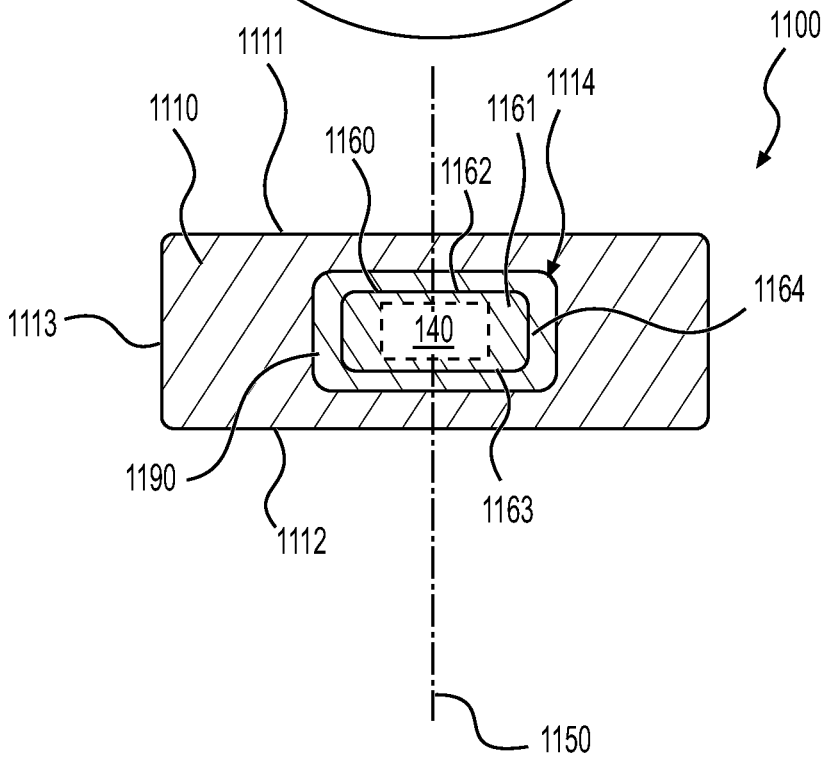
FIG. 26 is a cross-sectional view of the puck of FIG. 25 taken along the line 26-26 of FIG. 25.

Now referring to FIGS. 25 and 26, an eleventh embodiment of a hockey puck according to the present technology, namely hockey puck 1100, will be described. For conciseness, features of the hockey puck 1100 similar to those of the hockey pucks 100, 101, 200, 300, 400, 500, 600, 700, 800, 900, 1000 will not be described in detail herewith.

The hockey puck 1100 has a body 1110, an isolating layer 1190, an enclosure 1160 (sometimes referred to as receptacle), and a tracking device 140.

The body 1110 has a top surface 1111, a bottom surface 1112 spaced from the top surface 1111, and a peripheral surface 1113 extending between the top and bottom surfaces 1111, 1112. The body 1110 also defines an axis 1150 that extends at a centre thereof.

In this embodiment, a body cavity 1114 is defined within the body 1110. Specifically, the body cavity 114 extends along the axis 1150, from a first distance from the top surface 1111 to a second distance from the bottom surface 1112. In other words, the body cavity 1114 is fully defined within the body 1110. It is understood that in this embodiment, there is no cap. As will be described below, the body cavity 114 is configured to at least receive the tracking device 140 therein. In some embodiments, the body cavity 114 could be configured to receive the isolating layer 1190, the enclosure 1160 and the tracking device 140.

In this embodiment, the tracking device 140 is wrapped in the isolating layer 1190. The isolating layer 1190 protects the tracking device 140 from pressure, temperature and/or water infiltration which may be a problem during different manufacturing processes and/or operation. In some embodiments, the isolating layer 1190 could be made of a polyimide fiberboard material (e.g., Pyropel® thermoset polyimide) having thermal, mechanical and chemical properties suited for the conditions of manufacturing processes and/or operation of the hockey puck 1100. Other isolating materials and configurations are contemplated as well. In some cases, the isolating layer 1190 could be omitted.

In some embodiments, the enclosure 1160 is initially formed around the tracking device 140 and/or the isolating layer 1190 (e.g., by molding process), and the body 1110 is subsequently formed around the enclosure 1160 (e.g., by overmolding process), such that the body cavity 1114 is formed by surrounding the enclosure 1160. Other configurations or processes are contemplated as well.

The enclosure 1160 has an enclosure body 1161 that is configured to receive the tracking device 140 therein. The enclosure 1160 has a top surface 1162, a bottom surface 1163 spaced from the top surface 1162, and a peripheral surface 1164 extending between the top and bottom surfaces 1162, 1163. The enclosure 1160 is generally cylindrical, but other shapes are contemplated as well. For instance, the enclosure 1160 could be prismatic, spherical and/or have features for enhancing the mechanical interlock with the body 1110.

In some embodiments, the enclosure 1160 could be made of a shock resisting material (e.g., epoxy resin) for protecting the tracking device 140 against impacts during manufacturing and/or operation. Other materials are contemplated as well, for instance, and without being limited thereto, hard rubber.

A method for manufacturing the hockey puck 1100 will now be provided.

The method includes providing the tracking device 140.

The method also includes wrapping the tracking device 140 in the isolating layer 1190. In other words, the isolating layer 1190 surrounds the tracking device 140.

The method also includes forming the enclosure 1160 around the tracking device 140 and the isolating layer 1190. In some instances, the tracking device 140 is received in a preformed enclosure 1160.

The method also includes forming the body 1110 around the enclosure 1160. In some instances, the body 1110 is molded around the enclosure 1160. In some instances, the body is 1110 is molded around the enclosure 1160 such that a geometrical center of the body 1110 is aligned with the tracking device 140.

It is understood that the above-mentioned steps can be performed in a variety of orders. Additionally, the method could include more or less steps than those described hereabove.

Twelfth Embodiment

Figure 27:
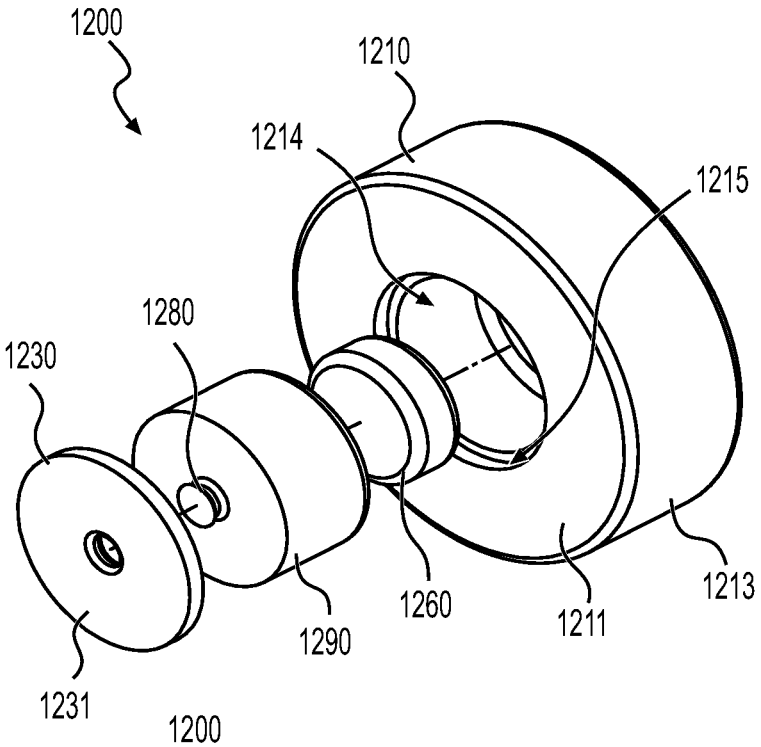
FIG. 27 is a perspective view of a puck according to an alternative embodiment of the present technology.
Figure 28:
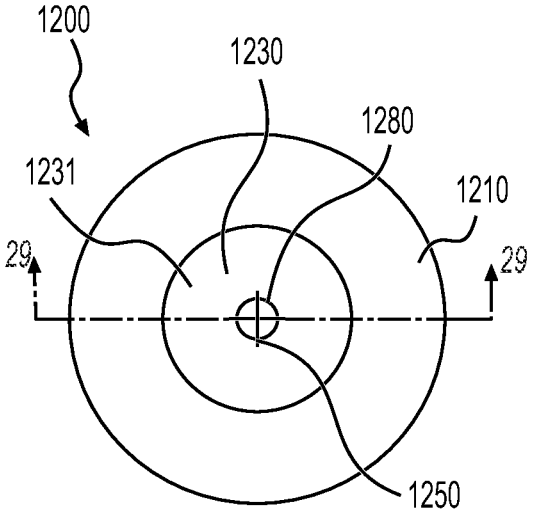
FIG. 28 is a top plan vie of the puck of FIG. 27.
Figure 29:
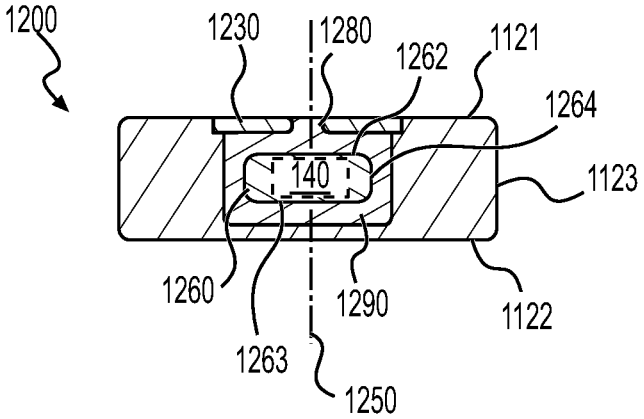
FIG. 29 is a cross-sectional view of the puck of FIG. 27 taken along the line 29-29 of FIG. 28.

Now referring to FIGS. 27 and 28, a twelfth embodiment of a hockey puck according to the present technology, namely hockey puck 1200, will be described. For conciseness, features of the hockey puck 1200 similar to those of the hockey pucks 100, 101, 200, 300, 400, 500, 600, 700, 800, 900, 1000, 1100 will not be described in detail herewith.

The hockey puck 1200 has a body 1210, a tracking device 140, an isolating layer 1290, enclosure 1260 and a cap 1230.

The body 1210 has a top surface 1211, a bottom surface 1212 spaced from the top surface 1211 and a peripheral surface 1213 extending between the top and bottom surfaces 1211, 1212. The body 1210 defines an axis 1250 that extends at a centre thereof.

The body 1210 defines a body cavity 1214 that extends along the axis 1250 from one top surface 1211 toward the bottom surface 1212. In some embodiments, the body cavity 1214 could extend from the bottom surface 1212 toward the top surface 1211. As will be described below, the body cavity 1214 is configured to receive the enclosure 1260 therein, and is generally complementary with the enclosure 1260. In some embodiments, the body 1210 is initially formed with the body cavity 1214, and the enclosure 1260 is then formed to fit into the body cavity 1214 by having a shape that is at least partially complementary to the body cavity 1214. In other embodiments, the body 1210 could be formed around the enclosure 1260 (e.g., via overmolding process), such that the body cavity 1214 is formed by surrounding the external surface of the enclosure 1260. Other configurations are contemplated as well.

In this embodiment, the tracking device 140 is wrapped in the isolating layer 1290, which protects the tracking device 140 from pressure, temperature and/or water infiltration during different manufacturing processes and/or operation. In some embodiments, the isolating layer 1290 could be made of a polyimide fiberboard material (e.g., Pyropel® thermoset polyimide) having thermal, mechanical and chemical properties suited for the conditions of manufacturing processes and/or operation of the hockey puck 1200. Other isolating materials and configurations are contemplated as well. In some cases, the isolating layer 1290 could be omitted.

As mentioned above, the body cavity 1214 is configured to at least receive the tracking device 140. In some embodiments, the body cavity 1214 is configured to receive the tracking device 140, the isolating layer 1290 and/or the enclosure 1260. The body cavity 1214 is generally complementary to the external surface of the enclosure 1260. In addition, the body cavity 1214 is configured to closed by the cap 1230 by receiving said cap 1230 within the body cavity 1214.

In some embodiments, the enclosure 1260 is initially formed around the tracking device 140 and/or the isolating layer 1290 (e.g., by molding process), and the body 1210 is subsequently formed around the enclosure 1260 (e.g., by overmolding process), such that the body cavity 1214 is formed by surrounding the enclosure 1260. Other configurations or processes are contemplated as well.

The enclosure 1260 has an enclosure body 1261. The enclosure body 1260 has a top surface 1262, a bottom surface 1263 spaced from the top surface 1262, and a peripheral surface 1264 extending between the top and bottom surfaces 1262, 1263. In this embodiment, the enclosure 1260 is generally cylindrical, but other shapes are contemplated as well. For instance, the enclosure can be prismatic, spherical, etc. and/or have features for enhancing the mechanical interlock with the body 1210.

The enclosure 1260 has a protruding portion 1280 extending the top surface 1262 thereof. In some embodiments, the protruding portion 1280 could extend from the bottom surface 1263. It is contemplated that the protruding portion 1280 could receive/surround and protect a charging base and/or a light-emitting device of the tracking device 140. The protruding portion 1280 extends until the top surface 1211. In other embodiments, protruding portion 1280 could not extend all the way to the top surface.

In some embodiments, the enclosure 1260 could be made of a shock resisting material (e.g., epoxy resin, soft plastic, soft rubber) for protecting the tracking device 140 against impacts during operation and/or manufacturing. In some embodiments, the enclosure 1260 could be made of a transparent material. In other embodiments, the enclosure 1260 could be made of the isolating material. Other materials are contemplated as well.

The cap 1230 has a cap body 1231 that is generally shaped as a disc. The cap body 1231 has a top surface 1232, a bottom surface 1233 spaced from the top surface 1232, and a peripheral surface 1234 extending between the top and bottom surfaces 1232, 1233. The cap body 1231 is configured to fit into the body cavity 1214. In some embodiments, the cap body 1231 could be oversized compared to the size of the body cavity 1214. In such embodiments, the cap body 1231 would be made of a material (e.g., hard rubber, hard resin) more rigid than the material of the body 1210 such that the body 1210 would elastically deform in response to the cap 1230 being pushed into place. In this embodiment, the cap body 1231 is larger than the body cavity 1214, and the body 1210 defines a groove 1215 configured to receive the cap 1230. In cases where the enclosure 1260 has a protruding portion 1280, the cap body 1231 defines an opening complementary to the protruding portion 1280, such that the protruding portion 1280 protrudes through the cap body 1231.

Upon assembly, the enclosure 1260 is within the body 1210. In some embodiments, an outer surface of the enclosure 1260 is in direct contact with body material of the body 1210. In other embodiments, the enclosure 1260 is surrounded by the isolating material, and it is the isolating material that is in direct contact with the body material. In some instances, the isolating material 1290 could be considered to be part of the enclosure 1260.

A method for manufacturing the hockey puck 1200 will now be described.

The method includes providing the tracking device 140.

The method includes wrapping the tracking device 140 in the isolating layer 1290.

The method includes forming the enclosure 1260 around the tracking device 140 and the isolating layer 1290.

The method includes forming the body 1210 around the enclosure 1260. In some embodiments, the body material of the body 1210 is molded around at least a portion of the enclosure 1260. In some instances, the body material of the body 1210 could be molded around a substantial portion of the enclosure 1260.

The method includes closing the aperture 1215 with the cap 1230.

An alternative method for manufacturing the hockey puck 1200 will now be described.

The method includes providing the tracking device 140.

The method includes wrapping the tracking device 140 in the isolating layer 1290.

The method includes forming the enclosure 1260 around the tracking device 140 and isolating layer 1290. The enclosure 1260 is formed so as to have the protrusion portion 1280.

The method includes installing the cap 1230 on the enclosure 1260, by aligning the protrusion portion 1280 with the aperture defined in the cap 1230 configured to receive the protrusion portion 1280.

The method includes forming the body 1210 around the enclosure 1260 and the cap 1230.

An alternative method for manufacturing the hockey puck 1200 will now be described.

The method includes providing the tracking device 140.

The method includes wrapping the tracking device 140 in the isolating layer 1290.

The method includes forming the enclosure 1260 around the tracking device 140 and the isolating layer 1290.

The method includes providing the body 1210 having the body cavity 1214.

The method includes inserting the enclosed track device 140 in the body cavity 1214.

The method includes closing the aperture 1215 with the cap 1230.

It is understood that the above-mentioned steps can be performed in a variety of orders. Additionally, the method could include more or fewer steps than those described hereabove.

Modifications and improvements to the above-described embodiments of the present invention may become apparent to those skilled in the art. The foregoing description is intended to be exemplary rather than limiting. The scope of the present invention is therefore intended to be limited solely by the appended claims.

What is claimed is:

1. A puck comprising:

a body;

a tracking device receivable in the body, and an isolating layer configured to withstand molding pressures of up to about 15000 kPa and molding temperatures of up to about 250° C.;

wherein the tracking device is generally aligned with a center of gravity of the body, and with a geometrical center of the body.

2. The puck of claim 1, further comprising a receptacle configured to receive the tracking device therein, and configured to be received in the body.

3. The puck of claim 2, wherein the receptacle has a protruding portion configured to receive part of the tracking device therein.

4. The puck of claim 3, wherein the part of the tracking device is at least one of a charging base and a light-emitting device.

5. The puck of claim 1, wherein the body defines a body cavity.

6. The puck of claim 5, wherein the body cavity extends from a first surface of the body toward a second surface of the body.

7. The puck of claim 6, further comprising a cap configured to close the body cavity.

8. The puck of claim 7, wherein the cap has a first connecting feature, the body has a second connecting feature, and the cap and the body are connectable via the first and second connecting features.

9. The puck of claim 1, wherein the tracking system is communicatively connectable to a controller.

10. A puck comprising:

a body made of a body material;

a receptacle within the body, an outer surface of the receptacle being in direct contact with the body material, the receptacle comprising an isolating material configured to withstand molding pressures of up to about 15000 kPa and molding temperatures of up to about 250° C.; and a tracking device received in the receptacle.

11. The puck of claim 10, wherein the tracking device is communicatively connectable to a controller.

12. The puck of claim 10, wherein the body material is molded around a substantial portion of the receptable.

13. The puck of claim 10, wherein the tracking device is generally aligned with a center of gravity of the body, and a geometrical center of the body.

14. The puck of claim 10, wherein the body material defines a body cavity extending from a first surface of the body toward a second surface of the body, and at least a portion of the receptacle extends until the first surface.

15. The puck of claim 14, wherein the at least a portion of the receptacle is a protruding portion configured to receive part of the tracking device therein.

16. The puck of claim 14, wherein the part of the tracking device is at least one of a charging base and a light-emitting device.

17. The puck of claim 14, further comprising a cap for closing the body cavity, the cap being configured to receive a protruding portion therethrough.

18. The puck of claim 10, being a hockey puck.

19. A method for manufacturing a puck, the method comprising:

a) receiving a tracking device in a receptacle;

b) molding a body material around the receptacle to form a body of the puck, such that the tracking device is generally aligned with a geometrical center of the body of the puck; and c) surrounding the receptacle with an isolating layer configured to withstand molding pressures of up to about 15000 kPa and molding temperatures of up to about 250° C.

* * * * *